US011414607B2

(12) United States Patent
Mountainland et al.

(10) Patent No.: US 11,414,607 B2
(45) Date of Patent: Aug. 16, 2022

(54) UPGRADED EBULLATED BED REACTOR WITH INCREASED PRODUCTION RATE OF CONVERTED PRODUCTS

(71) Applicant: HEADWATERS HEAVY OIL, LLC, South Jordan, UT (US)

(72) Inventors: David M. Mountainland, Princeton, NJ (US); Brett M. Silverman, Salt Lake City, UT (US); Michael A. Rueter, Plymouth Meeting, PA (US); Lee Smith, Pleasant Grove, UT (US)

(73) Assignee: Hydrocarbon Technology & Innovation, LLC, Lawrenceville, NJ (US)

( * ) Notice: Subject to any disclaimer, the term of this patent is extended or adjusted under 35 U.S.C. 154(b) by 535 days.

(21) Appl. No.: 15/258,653

(22) Filed: Sep. 7, 2016

(65) Prior Publication Data

US 2017/0081599 A1 Mar. 23, 2017

Related U.S. Application Data

(60) Provisional application No. 62/222,073, filed on Sep. 22, 2015.

(51) Int. Cl.
*C10G 65/00* (2006.01)
*C10G 75/00* (2006.01)
(Continued)

(52) U.S. Cl.
CPC ..... *C10G 65/00* (2013.01); *C10G 49/12* (2013.01); *C10G 49/26* (2013.01); *C10G 75/00* (2013.01);
(Continued)

(58) Field of Classification Search
CPC ..... C10G 45/04; C10G 45/34; C10G 45/46; C10G 45/60; C10G 47/02; C10G 49/02
See application file for complete search history.

(56) References Cited

U.S. PATENT DOCUMENTS 2,850,552 A 9/1958 Ogle
3,019,180 A 1/1962 Schreiener et al.
(Continued)

FOREIGN PATENT DOCUMENTS

CA 2004882 6/1991
CA 1295112 C 2/1992
(Continued)

OTHER PUBLICATIONS

U.S. Appl. No. 14/836,792, filed Aug. 26, 2015, Harris et al.
(Continued)

*Primary Examiner* — Michelle Stein
(74) *Attorney, Agent, or Firm* — Workman Nydegger

(57) ABSTRACT

An ebullated bed hydroprocessing system is upgraded using a dual catalyst system that includes a heterogeneous catalyst and dispersed metal sulfide particles to increase rate of production of converted products. The rate of production is achieved by increasing reactor severity, including increasing the operating temperature and at least one of throughput or conversion. The dual catalyst system permits increased reactor severity and provides increased production of converted products without a significant increase in equipment fouling and/or sediment production. In some cases, the rate of production of conversion products can be achieved while decreasing equipment fouling and/or sediment production.

23 Claims, 16 Drawing Sheets

(51) Int. Cl.
*C10G 49/26* (2006.01)
*C10G 49/12* (2006.01)

(52) U.S. Cl.
CPC . *C10G 2300/206* (2013.01); *C10G 2300/301* (2013.01); *C10G 2300/70* (2013.01); *C10G 2300/703* (2013.01)

(56) References Cited

U.S. PATENT DOCUMENTS 3,161,585 A 12/1964 Gleim et al.
3,254,017 A 5/1966 Arey, Jr. et al.
3,267,021 A 8/1966 Gould
3,297,563 A 1/1967 Doumani
3,349,713 A 10/1967 Fassbender
3,362,972 A 1/1968 Kollar
3,578,690 A 5/1971 Becker
3,595,891 A 7/1971 Cavitt
3,622,497 A 11/1971 Gleim
3,622,498 A 11/1971 Stolfa et al.
3,694,351 A 9/1972 White
3,694,352 A 9/1972 Gleim
3,816,020 A 6/1974 Ogles
3,870,623 A 3/1975 Johnson et al.
3,892,389 A 7/1975 Contastin
3,915,842 A 10/1975 Gatsis
3,919,074 A 11/1975 Gatsis
3,953,362 A 4/1976 Lines et al.
3,983,028 A 9/1976 McCollum et al.
3,992,285 A 11/1976 Hutchings
4,022,681 A 5/1977 Sheng et al.
4,066,530 A 1/1978 Aldridge et al.
4,066,561 A 1/1978 Nnadi
4,067,798 A 1/1978 Hauschildt et al.
4,067,799 A 1/1978 Bearden, Jr. et al.
4,068,830 A 1/1978 Gray
4,077,867 A 3/1978 Aldridge et al.
4,083,803 A 4/1978 Oswald et al.
4,125,455 A 11/1978 Herbstman
4,134,825 A 1/1979 Bearden, Jr. et al.
4,148,750 A 4/1979 Pine
4,151,070 A 4/1979 Allan et al.
4,169,038 A 9/1979 Metrailer et al.
4,178,227 A 12/1979 Metrailer et al.
4,181,601 A 1/1980 Sze
4,191,636 A 3/1980 Ando et al.
4,192,735 A 3/1980 Aldridge et al.
4,196,072 A 4/1980 Aldridge et al.
4,226,742 A 10/1980 Bearden, Jr. et al.
4,252,634 A 2/1981 Khulbe et al.
4,285,804 A 8/1981 Jacquin et al.
4,298,454 A 11/1981 Aldridge et al.
4,305,808 A 12/1981 Bowes
4,313,818 A 2/1982 Aldridge et al.
4,325,802 A 4/1982 Porter et al.
4,338,183 A 7/1982 Gatsis
4,352,729 A 10/1982 Jacquin et al.
4,370,221 A 1/1983 Patmore et al.
4,389,301 A 6/1983 Dahlberg et al.
4,411,768 A 10/1983 Unger et al.
4,420,008 A 12/1983 Shu
4,422,927 A 12/1983 Kowalczyk et al.
4,422,960 A 12/1983 Shiroto et al.
4,427,532 A 1/1984 Varghese
4,430,207 A 2/1984 Kukes
4,435,314 A 3/1984 van de Leemput et al.
4,452,265 A 6/1984 Lonnebring
4,454,023 A 6/1984 Lutz
4,455,218 A 6/1984 Dymock et al.
4,457,831 A 7/1984 Gendler
4,465,630 A 8/1984 Akashi et al.
4,467,049 A 8/1984 Yoshii et al.
4,485,004 A 11/1984 Fisher et al.
4,485,008 A 11/1984 Maa et al.
4,508,616 A 4/1985 Larrauri et al.
4,513,098 A 4/1985 Tsao
4,551,230 A 11/1985 Kukes et al.
4,557,823 A 12/1985 Kukes et al.
4,557,824 A 12/1985 Kukes et al.
4,561,964 A 12/1985 Singhal et al.
4,564,441 A 1/1986 Kukes et al.
4,567,156 A 1/1986 Bearden, Jr. et al.
4,568,657 A 2/1986 Sepulveda et al.
4,578,181 A 3/1986 Derouane et al.
4,579,646 A 4/1986 Grosboll et al.
4,581,344 A 4/1986 Ledoux et al.
4,582,432 A 4/1986 Mehta
4,585,545 A 4/1986 Yancey, Jr. et al.
4,590,172 A 5/1986 Isaacs
4,592,827 A 6/1986 Galiasso et al.
4,592,830 A 6/1986 Howell et al.
4,606,809 A 8/1986 Garg
4,608,152 A 8/1986 Howell et al.
4,613,427 A 9/1986 Sepulveda et al.
4,614,726 A 9/1986 Walters et al.
4,626,340 A 12/1986 Galiasso et al.
4,633,001 A 12/1986 Cells
4,652,311 A 3/1987 Gulla et al.
4,652,647 A 3/1987 Schlosberg et al.
4,674,885 A 6/1987 Erwin et al.
4,676,886 A 6/1987 Rahbe et al.
4,678,557 A 7/1987 Rodriguez et al.
4,693,991 A 9/1987 Bjornson et al.
4,695,369 A 9/1987 Garg et al.
4,701,435 A 10/1987 Garcia et al.
4,707,245 A 11/1987 Baldasarri et al.
4,707,246 A 11/1987 Gardner et al.
4,710,486 A 12/1987 Lopez et al.
4,713,167 A 12/1987 Reno et al.
4,716,142 A 12/1987 Laine et al.
4,724,069 A 2/1988 Aldag et al.
4,734,186 A 3/1988 Parrott et al.
4,740,295 A 4/1988 Bearden, Jr. et al.
4,746,419 A 5/1988 Peck et al.
4,762,607 A 8/1988 Aldridge et al.
4,762,812 A 8/1988 Lopez et al.
4,762,814 A 8/1988 Parrott et al.
4,764,266 A 8/1988 Chen et al.
4,765,882 A 8/1988 Aldridge et al.
4,770,764 A 9/1988 Ohtake et al.
4,772,378 A 9/1988 Miyauchi et al.
4,772,387 A 9/1988 Miyauchi et al.
4,802,972 A 2/1989 Kukes et al.
4,808,007 A 2/1989 King
4,812,228 A 3/1989 Angevine et al.
4,824,611 A 4/1989 Cells
4,824,821 A 4/1989 Lopez et al.
4,834,865 A 5/1989 Kukes et al.
4,837,193 A 6/1989 Akizuki et al.
4,851,107 A 7/1989 Kretschmar et al.
4,851,109 A 7/1989 Chen et al.
4,857,496 A 8/1989 Lopez et al.
4,859,309 A 8/1989 De Vries et al.
4,863,887 A 9/1989 Ohtake et al.
4,959,140 A 9/1990 Kukes et al.
4,963,247 A 10/1990 Belinko et al.
4,970,190 A 11/1990 Lopez et al.
4,983,273 A 1/1991 Kennedy et al.
4,983,558 A 1/1991 Born et al.
5,013,427 A 5/1991 Mosby et al.
5,017,535 A 5/1991 Schoonhoven et al.
5,017,712 A 5/1991 Usui et al.
5,038,392 A 8/1991 Morris et al.
5,039,392 A 8/1991 Bearden et al.
5,055,174 A 10/1991 Howell et al.
5,080,777 A 1/1992 Aegerter et al.
5,094,991 A 3/1992 Lopez et al.
5,108,581 A 4/1992 Aldridge et al.
5,114,900 A 5/1992 King
5,134,108 A 7/1992 Thakur et al.
5,154,818 A 10/1992 Harandi et al.
5,162,282 A 11/1992 Lopez et al.
5,164,075 A 11/1992 Lopez
5,166,118 A 11/1992 Kretschmar et al.
5,171,916 A 12/1992 Le et al.

(56) References Cited

U.S. PATENT DOCUMENTS 5,178,749 A 1/1993 Lopez et al.
5,191,131 A 3/1993 Takahata et al.
5,254,240 A 10/1993 Jacquin et al.
5,281,328 A 1/1994 Degnan, Jr. et al.
5,320,500 A 6/1994 Cholet
5,332,489 A 7/1994 Veluswamy
5,332,709 A 7/1994 Nappier et al.
5,358,634 A 10/1994 Rankel
5,364,524 A 11/1994 Partridge et al.
5,372,705 A * 12/1994 Bhattacharya ..... C10G 47/02 208/108
5,374,348 A 12/1994 Sears et al.
5,409,595 A 4/1995 Harandi et al.
5,435,908 A 7/1995 Nelson et al.
5,452,954 A 9/1995 Handke et al.
5,460,714 A 10/1995 Fixari et al.
5,474,977 A 12/1995 Gatsis
5,578,197 A 11/1996 Cyr et al.
5,597,236 A 1/1997 Fasano
5,622,616 A 4/1997 Porter et al.
5,865,537 A 2/1999 Streiff et al.
5,866,501 A 2/1999 Pradhan et al.
5,868,923 A 2/1999 Porter et al.
5,871,638 A 2/1999 Pradhan et al.
5,913,324 A 6/1999 Signer
5,916,432 A 6/1999 McFarlane et al.
5,925,235 A 7/1999 Habib
5,932,090 A 8/1999 Marchionna et al.
5,935,419 A 8/1999 Khan et al.
5,954,945 A 9/1999 Cayton et al.
5,962,364 A 10/1999 Wilson, Jr. et al.
5,972,202 A 10/1999 Benham et al.
6,004,453 A 12/1999 Benham et al.
6,059,957 A 5/2000 Khan et al.
6,068,758 A 5/2000 Strausz
6,086,749 A 7/2000 Kramer et al.
6,090,858 A 7/2000 El-Sayed
6,093,824 A 7/2000 Reichle et al.
6,136,179 A 10/2000 Sherwood, Jr. et al.
6,139,723 A 10/2000 Pelrine et al.
6,190,542 B1 2/2001 Comolliea et al.
6,214,195 B1 4/2001 Yadav et al.
6,217,746 B1 4/2001 Thakkar et al.
6,239,054 B1 5/2001 Shukis et al.
6,270,654 B1 8/2001 Colyar et al.
6,274,530 B1 8/2001 Cayton et al.
6,277,270 B1 8/2001 Morel et al.
6,309,537 B1 10/2001 Harle et al.
6,342,224 B1 1/2002 Bruck et al.
6,379,532 B1 4/2002 Hoehn et al.
6,454,932 B1 9/2002 Baldassari et al.
6,455,594 B1 9/2002 Tsuji
6,462,095 B1 10/2002 Bonsel et al.
6,550,960 B2 4/2003 Catalfamo et al.
6,596,155 B1 7/2003 Gates et al.
6,660,157 B2 12/2003 Que et al.
6,686,308 B2 2/2004 Mao et al.
6,698,197 B1 3/2004 Etchells, III et al.
6,698,917 B2 3/2004 Etchells et al.
6,712,955 B1 3/2004 Hou et al.
6,783,661 B1 8/2004 Briot et al.
6,797,153 B1 9/2004 Fukuyama et al.
6,884,340 B1 4/2005 Bogdan
6,916,762 B2 7/2005 Shibuya et al.
7,011,807 B2 3/2006 Zhou et al.
7,090,767 B2 8/2006 Kaminsky et al.
7,285,698 B2 10/2007 Liu et al.
7,449,103 B2 11/2008 Lott et al.
7,517,446 B2 4/2009 Lott et al.
7,578,928 B2 8/2009 Lott et al.
7,815,870 B2 10/2010 Lott et al.
7,951,745 B2 5/2011 Zhou et al.
8,034,232 B2 10/2011 Lott et al.
8,142,645 B2 3/2012 Zhou et al.
8,303,082 B2 11/2012 Lott et al.
8,303,802 B2 11/2012 Lott et al.
8,309,041 B2 11/2012 Lott et al.
8,557,105 B2 3/2013 Lott et al.
8,431,016 B2 4/2013 Lott et al.
8,435,400 B2 5/2013 Kou et al.
8,440,071 B2 5/2013 Lott et al.
8,445,399 B2 5/2013 Wu et al.
8,673,130 B2 3/2014 Lott et al.
9,605,215 B2 3/2017 Lott et al.
2002/0179493 A1 12/2002 Etter
2003/0094400 A1 5/2003 Levy et al.
2003/0171207 A1 9/2003 Shih et al.
2004/0013601 A1 1/2004 Butz et al.
2004/0147618 A1 7/2004 Lee et al.
2005/0109674 A1 5/2005 Klein
2005/0241991 A1* 11/2005 Lott ..... B01J 8/226 208/108
2005/0241992 A1 11/2005 Lott et al.
2005/0241993 A1 11/2005 Lott et al.
2005/0258073 A1 11/2005 Oballa et al.
2005/0279670 A1 12/2005 Long et al.
2006/0060501 A1 3/2006 Gauthier
2006/0079396 A1 4/2006 Saito
2006/0175229 A1 8/2006 Montanari et al.
2006/0201854 A1 9/2006 Lott et al.
2006/0224000 A1 10/2006 Papp et al.
2006/0254956 A1 11/2006 Khan
2006/0289340 A1 12/2006 Brownscombe et al.
2007/0012595 A1 1/2007 Brownscombe et al.
2007/0029228 A1 2/2007 Aoki et al.
2007/0108100 A1 5/2007 Satchell, Jr.
2007/0131587 A1 6/2007 Fukuyama et al.
2007/0138059 A1 6/2007 Farshid et al.
2007/0158236 A1 7/2007 Zhou et al.
2007/0158238 A1 7/2007 Wu et al.
2007/0158239 A1 7/2007 Satchell
2007/0163921 A1 7/2007 Keusenkothen et al.
2007/0175797 A1 8/2007 Iki et al.
2007/0209965 A1 9/2007 Duddy et al.
2008/0107881 A1 5/2008 Nakashiba et al.
2009/0152165 A1 6/2009 Etter
2009/0159505 A1 6/2009 Da Costa et al.
2009/0308792 A1 12/2009 Wu et al.
2009/0310435 A1 12/2009 Lott et al.
2010/0065472 A1 3/2010 Chabot
2010/0122931 A1 5/2010 Zimmerman et al.
2011/0017637 A1 1/2011 Reynolds et al.
2011/0017641 A1 1/2011 Gupta et al.
2012/0152805 A1 6/2012 Chabot et al.
2013/0068858 A1 3/2013 Nuzzo et al.
2013/0075304 A1 3/2013 Chang et al.
2013/0233765 A1 9/2013 Lott et al.
2014/0027344 A1 1/2014 Harris et al.
2014/0093433 A1 4/2014 Lott et al.
2014/0291203 A1 10/2014 Molinari et al.
2015/0361360 A1 12/2015 Harris et al.
2017/0066978 A1 3/2017 Lott et al.
2017/0081599 A1 3/2017 Mountainland et al.
2017/0081600 A1 3/2017 Mountainland et al.

FOREIGN PATENT DOCUMENTS

CA 2088402 7/1993
CA 2579528 9/2007
CN 1219570 6/1999
CN 1295112 5/2001
CN 1448482 A 10/2003
CN 2579528 Y 10/2003
CN 1933766 A 3/2007
CN 1950484 A 4/2007
CN 1966618 5/2007
CN 101015440 A 8/2007
CN 202960636 U 6/2013
CN 103228355 A 7/2013
CN 104349804 A 2/2015
CN 106535954 A 3/2017
CN 108531215 A 9/2018
CO 2018/0002377 A1 7/2018
DE 2315114 10/1974

(56) References Cited

FOREIGN PATENT DOCUMENTS

| | | | |
|---|---|---|---|
| EA | 201590288 | A1 | 6/2015 |
| EP | 0199399 | | 10/1986 |
| EP | 0546686 | | 6/1993 |
| EP | 0559399 | | 9/1993 |
| EP | 0753846 | A1 | 1/1997 |
| EP | 1043069 | | 10/2000 |
| EP | 1753846 | | 2/2007 |
| EP | 1893666 | A1 | 3/2008 |
| EP | 2811006 | A1 | 12/2014 |
| EP | 3369801 | A1 | 9/2018 |
| GB | 1047698 | | 8/1963 |
| JP | Sho47-014205 | | 10/1972 |
| JP | Sho 59-108091 | | 6/1984 |
| JP | Hei 60-044587 | | 3/1985 |
| JP | 61-195155 | A | 8/1986 |
| JP | Sho 62-39634 | | 8/1987 |
| JP | 01-165692 | A | 6/1989 |
| JP | 2001-165692 | | 6/1989 |
| JP | 2863858 | | 2/1990 |
| JP | 05-339357 | A | 12/1993 |
| JP | Hei 06-009966 | | 1/1994 |
| JP | Hei 06-287574 | | 10/1994 |
| JP | Hei 06-346064 | | 12/1994 |
| JP | Hei 07-062355 | | 3/1995 |
| JP | Hei 7-90282 | | 4/1995 |
| JP | Hei 08-325580 | | 12/1996 |
| JP | 2000-502146 | | 2/2000 |
| JP | 2003-193074 | | 7/2003 |
| JP | 2007-535604 | A | 12/2007 |
| JP | 2009-541499 | A | 11/2009 |
| JP | 2011-502204 | | 1/2011 |
| JP | 2015-527452 | A | 9/2015 |
| JP | 2018-532839 | A | 11/2018 |
| KR | 10-2007-0018923 | A | 2/2007 |
| RU | 2181751 | C2 | 4/2002 |
| WO | 1997/23582 | | 12/1996 |
| WO | 1997/34967 | | 3/1997 |
| WO | 97/29841 | A2 | 8/1997 |
| WO | 00/01408 | A2 | 1/2000 |
| WO | 2000/75336 | | 12/2000 |
| WO | 2001/01408 | | 1/2001 |
| WO | 2001/41799 | | 6/2001 |
| WO | 2005/104749 | | 11/2005 |
| WO | 2005/104752 | A2 | 11/2005 |
| WO | 2006/116913 | | 11/2006 |
| WO | 2006/132671 | A1 | 12/2006 |
| WO | 2007/078622 | | 7/2007 |
| WO | 2007/106783 | | 9/2007 |
| WO | 2008/151972 | A2 | 12/2008 |
| WO | 2009-058785 | | 5/2009 |
| WO | 2010/033487 | A2 | 3/2010 |
| WO | 2012/088585 | A1 | 7/2012 |
| WO | 2017/053117 | A1 | 3/2017 |

OTHER PUBLICATIONS

U.S. Appl. No. 15/258,706, filed Sep. 7, 2016, Mountainland et al.
U.S. Appl. No. 15/354,230, filed Nov. 17, 2016, Lott et la.
Aspen Hydrocracker™: A simulation system for monitoring, planning and optimizing hydrocracking and hydrotreating units, www.aspentec.com/brochures/hydrocracker.pdf (2001).
Criterion: Hydrocracking Process Description and Criterion/Zeolyst Hydrocracking Catalyst Applications, www.criterioncatalysts.com (2001).
Database CA [online] Chemical Abstracts Service retrieved from STN Database accession No. 1991:42412.
Alberto Del Bianco et al. "Upgrading Heavy Oil Using Slurry Processes" Chemtech, Nov. 30, 1995 (Nov. 30, 1995), pp. 35-43.
Lewis, Richard J., Hawley's Condensed Chemical Dictionary, 15 Edition, 2007, p. 321.
"Hyvahl, Significantly Improved RFCC Performance or Low Sulfur Fuel Oils Via Residue Hydrotreatment", Axens IPF Group Technologies, pp. 1,2 (Jan. 2003).
Roger K. Lott et al.: "(HC)3 Process—A Slurry Hydrocracking Technology Designed to Convert Bottoms of Heavy Oils" 7th UNITAR International Conference of Heavy Crude and Tar Sands, Beijing, Oct. 27, 1998 (Oct. 27, 1998) pp. 1-8.
Molecular Profile Report, Cobalt Benzoate, http://chemfinder.cambridgesoft.com/chembiofinder/forms/search/contentarea/chembiovizsearch.aspx?formgroupid=8&appname=chembiofinder&allowfullsearch-true&keeprecordcountsynchronized-flase&searchcriteraid=47searchcriteravalue=932-69-4&currentindex=0.
"OCR Moving Bed Technology for the future", pp. 1-2 (at least as early as 2004).
N. Panariti et al.: "petroleum Residue Upgrading with Dispered Catalysts Part 1. Catalysts Activity and Selctivity" Applied Catalysts A: General, vol. 204, Mar. 31, 2000 (Mar. 1, 2000) pp. 203-213.
"Petroleum Residue Upgrading with Dispersed Catalysts Part 2. Effect of Operating Conditions" Applied Catalysts A: General, vol. 204, Mar. 31, 2000 (Mar. 1, 2000) pp. 215-222.
Papaioannou et al., "Alkali-Metal- and Alkaline-Earth-Promoted Catalysts for Coal Liquefaction Applications", Energy & Fuels, vol. 4, No. 1, pp. 38-42 (1990).
Seader et al., "Perry's Chemical Engineers' Handbook", 7th Edition, Section 13—Distillation, 1997, 13-25.
Plain et al., "Options for Resid Conversion", Axens IFP Group Technologies, pp. 1-10 (at least as early as 2004).
Santori, R., et al., "Eni Slurry Technology: A Technology to Convert the Bottom of the Barrel to Transportation Fuels", 3rd Bottom of the Barrell Technology Conference & Exhibition (Oct. 2004).
Hydrocracking of Liaohe Vacuum Residue With Bimeta:, Shen et al., Preprints of Symposia—American Chemical society, Division of Fuel Chemistry (1998), 43(3), 481-485, OCDEN: Psadfz, 1998, XP009117504.
Mcfarlane et al. "Dispersion and Activity of Inorganic Catalyst Precursor in Heavy Oul" Boston Congress ACS Energy and Fuel Diversification, p. 496, Aug. 31, 1998.
U.S. Appl. No. 13/866,220, filed Nov. 13, 2006, Notice of Allowance.
U.S. Appl. No. 11/117,262, filed Feb. 4, 2008, Office Action.
U.S. Appl. No. 11/117,202, filed Apr. 29, 2008, Office Action.
U.S. Appl. No. 11/117,203, filed Jul. 10, 2008, Office Action.
U.S. Appl. No. 11/117,262, filed Jul. 17, 2008, Office Action.
U.S. Appl. No. 11/117,202, filed Aug. 18, 2008, Notice of Allowance.
U.S. Appl. No. 11/117,262, filed Dec. 5, 2008, Office Action.
U.S. Appl. No. 11/117,203, filed Dec. 10, 2008, Notice of Allowance.
U.S. Appl. No. 11/117,262, filed Apr. 30, 2009, Notice of Allowance.
U.S. Appl. No. 11/374,369, filed May 28, 2009, Office Action.
U.S. Appl. No. 11/117,262, filed Jun. 26, 2009, Notice of Allowance.
U.S. Appl. No. 11/932,201, filed Nov. 23, 2009, Office Action.
U.S. Appl. No. 12/106,112, filed Jan. 26, 2010, Office Action.
U.S. Appl. No. 11/374,369, filed Mar. 18, 2010, Office Action.
U.S. Appl. No. 11/932,201, filed May 13, 2010, Office Action.
U.S. Appl. No. 12/106,112, filed Jun. 22, 2010, Notice of Allowance.
U.S. Appl. No. 11/968,934, filed Sep. 20, 2010, Office Action.
U.S. Appl. No. 12/838,76, filed Nov. 26, 2010, Office Action.
U.S. Appl. No. 11/968,934, filed Jan. 25, 2011, Office Action.
U.S. Appl. No. 11/932,201, filed Apr. 21, 2011, Notice of Allowance.
U.S. Appl. No. 12/838,761, filed May 18, 2011, Office Action.
U.S. Appl. No. 11/932,201, filed Jun. 8, 2011, Notice of Allowance.
U.S. Appl. No. 11/968,934, filed Jul. 12, 2011, Office Action.
U.S. Appl. No. 13/236,209, filed Sep. 19, 2011, Office Action.
U.S. Appl. No. 12/547,278, filed Dec. 29, 2011, Office Action.
U.S. Appl. No. 11/968,934, filed Jan. 6, 2012, Notice of Allowance.
U.S. Appl. No. 13/116,195, filed Jan. 12, 2012, Office Action.
U.S. Appl. No. 13/236,209, filed Jul. 11, 2012, Notice of Allowance.
U.S. Appl. No. 13/116,195, filed Jul. 11, 2012, Notice of Allowance.
U.S. Appl. No. 12/838,761, filed Jul. 20, 2012, Office Action.
U.S. Appl. No. 13/113,722, filed Aug. 8, 2012, Office Action.

(56) References Cited

OTHER PUBLICATIONS

U.S. Appl. No. 12/547,278, filed Sep. 7, 2012, Office Action.
U.S. Appl. No. 12/838,761, filed Jan. 10, 2013, Notice of Allowance.
U.S. Appl. No. 13/113,722, filed Jan. 22, 2013, Notice of Allowance.
U.S. Appl. No. 13/675,629, filed Feb. 7, 2013, Office Action.
U.S. Appl. No. 13/675,629, filed Jun. 14, 2013, Notice of Allowance.
U.S. Appl. No. 13/866,220, filed Jun. 28, 2013, Office Action.
U.S. Appl. No. 13/866,220, filed Nov. 6, 2013, Notice of Allowance.
U.S. Appl. No. 14/095,698, filed Dec. 3, 2013, Office Action.
U.S. Appl. No. 11/374,369, filed Mar. 12, 2014, Office Action.
U.S. Appl. No. 12/547,278, filed Apr. 22, 2014, Office Action.
U.S. Appl. No. 13/242,979, filed Aug. 21, 2014, Office Action.
U.S. Appl. No. 11/374,369, filed Aug. 28, 2014, Office Action.
U.S. Appl. No. 12/547,278, filed Nov. 24, 2014, Final Office Action.
U.S. Appl. No. 13/242,979, filed Mar. 12, 2015, Final Office Action.
U.S. Appl. No. 13/865,726, filed May 12, 2015, Office Action.
U.S. Appl. No. 13/561,479, filed Aug. 11, 2015, Office Action.
U.S. Appl. No. 13/561,479, filed Nov. 4, 2015, Final Office Action.
U.S. Appl. No. 13/865,726, filed Jan. 11, 2016, Final Office Action.
U.S. Appl. No. 13/561,479, filed Apr. 27, 2016, Office Action.
U.S. Appl. No. 11/374,369, filed May 18, 2016, Office Action.
U.S. Appl. No. 12/547,278, filed Oct. 28, 2016, Office Action.
U.S. Appl. No. 11/374,369, filed Nov. 9, 2016, Final Office Action.
U.S. Appl. No. 14/836,792, filed Apr. 11, 2017, Office Action.
U.S. Appl. No. 12/547,278, filed Apr. 14, 2017, Final Office Action.
Office Action received for EA Patent Application No. 201892721, dated Jul. 8, 2020, 8 pages (4 pages of English Translation and 4 pages of Original Document).
Course: Chemical Technology (Organic) Module VI, Lecture 5 Catalytic Cracking: Fluid Catalytic Cracking and Hydrocracking downloaded Jun. 2019.
Final Office Action received for U.S. Appl. No. 13/865,726, dated Aug. 14, 2017.
Final Office Action received for U.S. Appl. No. 13/865,726, dated Jan. 13, 2017.
Hawley's Condensed Chemical Dictionary, Richard J. Lewis, Sr. 15 Edition, 2007, p. 321.
Lee, Sunggyu et al, Handook of Alternative Fuel Technologies, 2007, pp. 187-188.
Notice of Allowance dated Aug. 5, 2010 cited in U.S. Appl. No. 11/461,652.
Notice of Allowance dated Oct. 27, 2009 cited in U.S. Appl. No. 11/327,085.
Office Action dated Apr. 2, 2009 cited in U.S. Appl. No. 11/327,085.
Office Action dated Mar. 8, 2010 cited in U.S. Appl. No. 11/461,652.
Office Action dated Sep. 16, 2010 cited in U.S. Appl. No. 11/968,861.
Office Action dated Sep. 30, 2009 cited in U.S. Appl. No. 11/461,652.
Office Action received for U.S. Appl. No. 11/374,369, dated Sep. 1, 2017.
Office Action received for U.S. Appl. No. 12/547,278, dated Nov. 29, 2017.
Office Action received for U.S. Appl. No. 13/236,209, dated Feb. 21, 2012.
Office Action received for U.S. Appl. No. 13/865,726, dated Apr. 26, 2017.
Office Action received for U.S. Appl. No. 13/865,726, dated Aug. 30, 2016.
Office Action received for U.S. Appl. No. 15/354,230, dated Jun. 12, 2018.
Panariti et al., "Petroleum residue upgrading with dispersed catalysts Part 1. Catalysts activity and sensitivity", Mar. 31, 2000, pp. 203-213.
Rana et al., A Review of recent advances on process technologies for upgrading of heavy oils and residua, Sep. 7, 2016, full text, retrieved from http://www.sciencedirect.com/science/article/pii/S001623610600295X on Aug. 8, 2017.
Shen et al, Hydrocracking of Liaohe Vacuum Residue With Bimeta:, Shen et al., Preprints of Symposia—American Chemical society, Division of Fuel Chemistry (1998), 43(3), 481-485, OGDEN: Psadfz, 1998, XP009117504.
U.S. Appl. filed Apr. 18, 2013, Lott et al., U.S. Appl. No. 13/856,726.
U.S. Appl. filed Dec. 3, 2013, Lott et al., U.S. Appl. No. 14/095,698.
U.S. Appl. No. 11/327,249, filed Jan. 6, 2006, Zhou et al.
U.S. Appl. No. 11/968,861, filed Feb. 2, 2011, Notice of Allowance.
U.S. Application Filed on Apr. 19, 2013, by Lott et al., U.S. Appl. No. 13/866,220.
U.S. Application Filed on Sep. 7, 2016, by Mountainland et al., U.S. Appl. No. 15/258,653.
U.S. Patent Application filed on Apr. 19, 2013, by Lott et al., U.S. Appl. No. 13/865,726.
U.S. Patent Application filed on Jul. 30, 2012, by Harris et al., U.S. Appl. No. 13/561,479.
U.S. Patent Application filed on Jun. 6, 2017, by Mountainland et al., U.S. Appl. No. 15/615,574.
U.S. Patent Application filed on May 23, 2011, by Lott et al., U.S. Appl. No. 13/113,722.
US. Appl. filed May 26, 2011, Lott et al., U.S. Appl. No. 13/116,195.
Ex Parte Quayle Action received for U.S. Appl. No. 11/374,369, mailed on Sep. 21, 2020, 5 pages.
Non-Final Office Action received for U.S. Appl. No. 16/594,847, dated Nov. 13, 2020, 8 pages.

* cited by examiner

UPGRADED EBULLATED BED REACTOR WITH INCREASED PRODUCTION RATE OF CONVERTED PRODUCTS

CROSS REFERENCE TO RELATED APPLICATIONS

This application claims the benefit of U.S. Provisional Patent Application No. 62/222,073, filed Sep. 22, 2016, the disclosure of which is incorporated herein in its entirety.

BACKGROUND OF THE INVENTION

1. The Field of the Invention

The invention relates to heavy oil hydroprocessing methods and systems, such as ebullated bed hydroprocessing methods and systems, which utilize a dual catalyst system and operate at increased reactor severity.

2. The Relevant Technology

There is an ever-increasing demand to more efficiently utilize low quality heavy oil feedstocks and extract fuel values therefrom. Low quality feedstocks are characterized as including relatively high quantities of hydrocarbons that nominally boil at or above 524° C. (975° F.). They also contain relatively high concentrations of sulfur, nitrogen and/or metals. High boiling fractions derived from these low quality feedstocks typically have a high molecular weight (often indicated by higher density and viscosity) and/or low hydrogen/carbon ratio, which is related to the presence of high concentrations of undesirable components, including asphaltenes and carbon residue. Asphaltenes and carbon residue are difficult to process and commonly cause fouling of conventional catalysts and hydroprocessing equipment because they contribute to the formation of coke. Furthermore, carbon residue places limitations on downstream processing of high boiling fractions, such as when they are used as feeds for coking processes.

Lower quality heavy oil feedstocks which contain higher concentrations of asphaltenes, carbon residue, sulfur, nitrogen, and metals include heavy crude, oil sands bitumen, and residuum left over from conventional refinery process. Residuum (or "resid") can refer to atmospheric tower bottoms and vacuum tower bottoms. Atmospheric tower bottoms can have a boiling point of at least 343° C. (650° F.) although it is understood that the cut point can vary among refineries and be as high as 380° C. (716° F.). Vacuum tower bottoms (also known as "resid pitch" or "vacuum residue") can have a boiling point of at least 524° C. (975° F.), although it is understood that the cut point can vary among refineries and be as high as 538° C. (1000° F.) or even 565° C. (1050° F.).

By way of comparison, Alberta light crude contains about 9% by volume vacuum residue, while Lloydminster heavy oil contains about 41% by volume vacuum residue, Cold Lake bitumen contains about 50% by volume vacuum residue, and Athabasca bitumen contains about 51% by volume vacuum residue. As a further comparison, a relatively light oil such as Dansk Blend from the North Sea region only contains about 15% vacuum residue, while a lower-quality European oil such as Ural contains more than 30% vacuum residue, and an oil such as Arab Medium is even higher, with about 40% vacuum residue. These examples highlight the importance of being able to convert vacuum residues when lower-quality crude oils are used.

Converting heavy oil into useful end products involves extensive processing, such as reducing the boiling point of the heavy oil, increasing the hydrogen-to-carbon ratio, and removing impurities such as metals, sulfur, nitrogen and coke precursors. Examples of hydrocracking processes using conventional heterogeneous catalysts to upgrade atmospheric tower bottoms include fixed-bed hydroprocessing, ebullated-bed hydroprocessing, and moving-bed hydroprocessing. Noncatalytic upgrading processes for upgrading vacuum tower bottoms include thermal cracking, such as delayed coking, flexicoking, visbreaking, and solvent extraction.

SUMMARY OF THE INVENTION

Disclosed herein are methods for upgrading an ebullated bed hydroprocessing system to increase the rate of production of converted products from heavy oil. Also disclosed are upgraded ebullated bed hydroprocessing systems formed by the disclosed methods. The disclosed methods and systems involve the use of a dual catalyst system comprised of a solid supported catalyst and well-dispersed (e.g., homogeneous) catalyst particles. The dual catalyst system permits an ebullated bed reactor to operate at higher severity compared to the same reactor using only the solid supported catalyst.

In some embodiments, a method of upgrading an ebullated bed hydroprocessing system to increase rate of production of converted products from heavy oil, comprises: (1) operating an ebullated bed reactor using a heterogeneous catalyst to hydroprocess heavy oil at initial conditions, including (i) an initial reactor severity and (ii) an initial rate of production of converted products; (2) thereafter upgrading the ebullated bed reactor to operate using a dual catalyst system comprised of dispersed metal sulfide catalyst particles and heterogeneous catalyst; and (3) operating the upgraded ebullated bed reactor at (iii) a higher reactor severity and (iv) an increased rate of production of converted products than when initially operating the ebullated bed reactor.

In some embodiments, operating at higher severity includes: increasing throughput of heavy oil and operating temperature of the ebullated bed reactor while maintaining or increasing conversion of the heavy oil than when operating the ebullated bed reactor at the initial conditions. In other embodiments, operating at higher severity includes increasing conversion of heavy oil and operating temperature of the ebullated bed reactor while maintaining or increasing throughput of the heavy oil than when operating the ebullated bed reactor at the initial conditions. In yet other embodiments, operating at higher severity includes increasing conversion, throughput of heavy oil, and operating temperature of the ebullated bed reactor than when operating the ebullated bed reactor at the initial conditions.

In some embodiments, an increased throughput of heavy oil is at least 2.5%, 5%, 10%, or 20% higher than when operating the ebullated bed reactor at the initial conditions. In some embodiments, the increased conversion of heavy oil is at least 2.5%, 5%, 7.5%, 10%, or 15% higher than when operating the ebullated bed reactor at the initial conditions. In some embodiments, the increased temperature is at least 2.5° C., 5° C., 7.5° C., or 10° C. higher than when operating at the initial conditions. It will be appreciated, however, that in specific cases the exact temperature increase required to achieve the desired increase in rate of production of converted products can depend on the type of feedstock being processed and may vary somewhat from the temperature levels listed above. This is due to differences in the intrinsic reactivity of different types of feedstocks.

In some embodiments, the dispersed metal sulfide catalyst particles are less than 1 μm in size, or less than about 500 nm in size, or less than about 250 nm in size or less than about 100 nm in size, or less than about 50 nm in size, or less than about 25 nm in size, or less than about 10 nm in size, or less than about 5 nm in size.

In some embodiments, the dispersed metal sulfide catalyst particles are formed in situ within the heavy oil from a catalyst precursor. By way of example and not limitation, the dispersed metal sulfide catalyst particles can be formed by blending a catalyst precursor into an entirety of the heavy oil prior to thermal decomposition of the catalyst precursor and formation of active metal sulfide catalyst particles. By way of further example, methods may include mixing a catalyst precursor with a diluent hydrocarbon to form a diluted precursor mixture, blending the diluted precursor mixture with the heavy oil to form conditioned heavy oil, and heating the conditioned heavy oil to decompose the catalyst precursor and form the dispersed metal sulfide catalyst particles in situ.

In some embodiments, a method of upgrading an ebullated bed hydroprocessing system to increase rate of production of converted products from heavy oil comprises: (1) operating an ebullated bed reactor using a heterogeneous catalyst to hydroprocess heavy oil at initial conditions, including (i) an initial throughput, (ii) operating temperature, (iv) initial rate of production of converted products, and (iv) initial rate of fouling and/or sediment production; (2) thereafter upgrading the ebullated bed reactor to operate using a dual catalyst system comprised of dispersed metal sulfide catalyst particles and heterogeneous catalyst; and (3) operating the upgraded ebullated bed reactor at a higher throughput, a higher operating temperature, an increased the rate of production of converted products, and at a rate of fouling and/or sediment production equal to or less than when operating at the initial conditions.

In some embodiments, a method of upgrading an ebullated bed hydroprocessing system to increase rate of production of converted products from heavy oil comprises: (1) operating an ebullated bed reactor using a heterogeneous catalyst to hydroprocess heavy oil at initial conditions, including (i) an initial conversion, (ii) an initial operating temperature, (iii) an initial rate of production of converted products, and (iv) an initial rate of fouling and/or sediment production; (2) thereafter upgrading the ebullated bed reactor to operate using a dual catalyst system comprised of dispersed metal sulfide catalyst particles and heterogeneous catalyst; and (3) operating the upgraded ebullated bed reactor to hydroprocess heavy oil at a higher conversion, a higher operating temperature, an increased rate of production of converted products, and at a rate of fouling and/or sediment production equal to or less than when operating at the initial conditions.

These and other advantages and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings, in which.

DETAILED DESCRIPTION OF THE PREFERRED EMBODIMENTS

I. Introduction and Definitions

The present invention relates to methods for upgrading an ebullated bed hydroprocessing system to increase the rate of production of converted products from heavy oil and upgraded ebullated bed hydroprocessing systems formed by the disclosed methods. The methods and systems include (1) using a dual catalyst system and (2) operating an ebullated bed reactor at higher reactor severity to increase the rate of production of converted products.

By way of example, a method of upgrading an ebullated bed hydroprocessing system to increase rate of production of converted products from heavy oil, comprises: (1) operating an ebullated bed reactor using a heterogeneous catalyst to hydroprocess heavy oil at initial conditions, including (i) an initial reactor severity and (ii) an initial rate of production of converted products; (2) thereafter upgrading the ebullated bed reactor to operate using a dual catalyst system comprised of dispersed metal sulfide catalyst particles and heterogeneous catalyst; and (3) operating the upgraded ebullated bed reactor at (iii) a higher reactor severity and (iv) an increased rate of production of converted products than when initially operating the ebullated bed reactor.

The term "heavy oil feedstock" shall refer to heavy crude, oil sands bitumen, bottom of the barrel and residuum left over from refinery processes (e.g., visbreaker bottoms), and any other lower quality materials that contain a substantial quantity of high boiling hydrocarbon fractions and/or that include a significant quantity of asphaltenes that can deactivate a heterogeneous catalyst and/or cause or result in the formation of coke precursors and sediment. Examples of heavy oil feedstocks include, but are not limited to, Lloydminster heavy oil, Cold Lake bitumen, Athabasca bitumen, atmospheric tower bottoms, vacuum tower bottoms, residuum (or "resid"), resid pitch, vacuum residue (e.g., Ural VR, Arab Medium VR, Athabasca VR, Cold Lake VR, Maya VR, and Chichimene VR), deasphalted liquids obtained by solvent deasphalting, asphaltene liquids obtained as a byproduct of deasphalting, and nonvolatile liquid fractions that remain after subjecting crude oil, bitumen from tar sands, liquefied coal, oil shale, or coal tar feedstocks to distillation, hot separation, solvent extraction, and the like. By way of further example, atmospheric tower bottoms (ATB) can have a nominal boiling point of at least 343° C. (650° F.) although it is understood that the cut point can vary among refineries and be as high as 380° C. (716° F.). Vacuum tower bottoms can have a nominal boiling point of at least 524° C. (975° F.), although it is understood that the cut point can vary among refineries and be as high as 538° C. (1000° F.) or even 565° C. (1050° F.).

Figure 1:
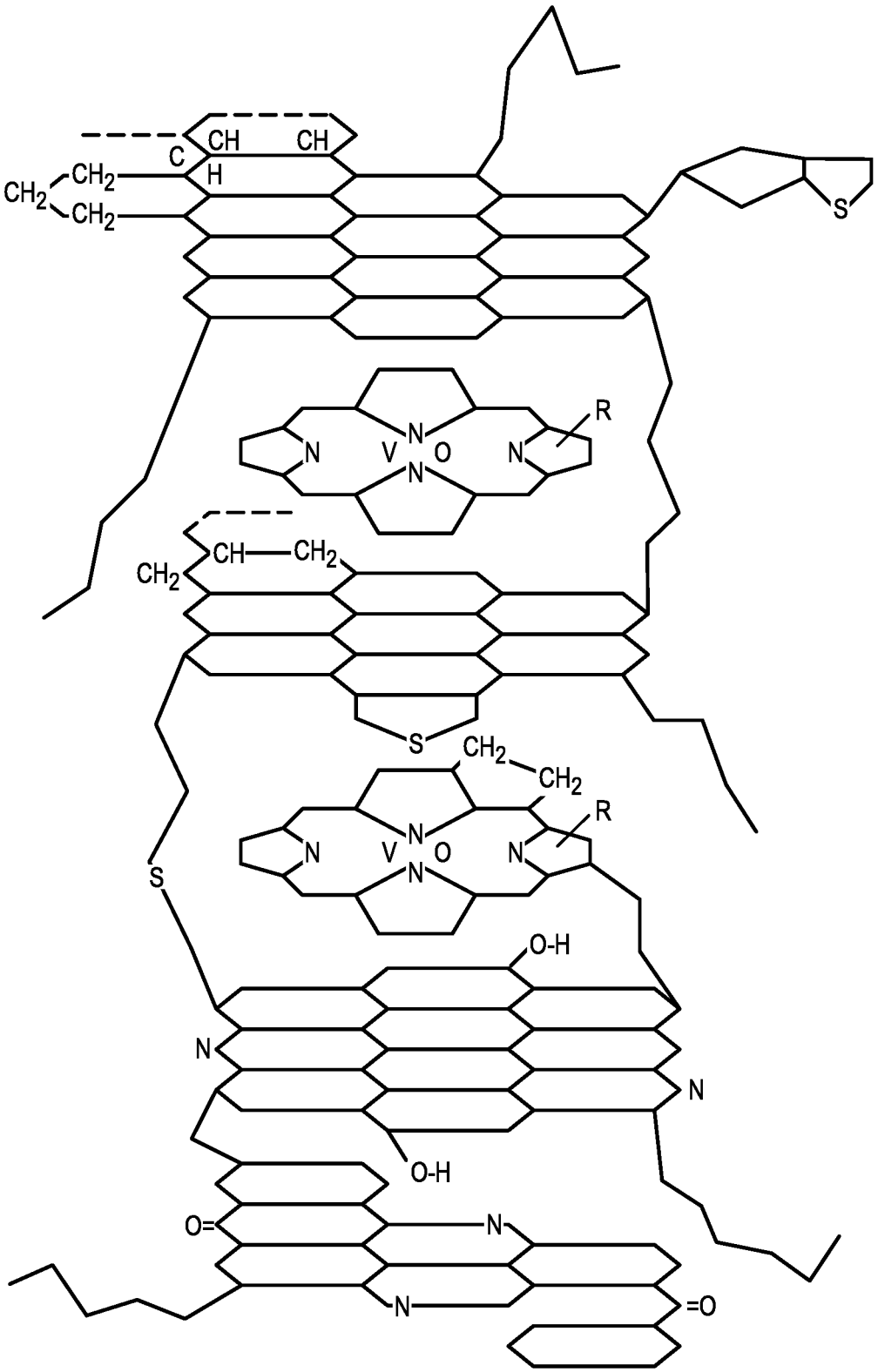
FIG. 1 depicts a hypothetical molecular structure of asphaltene.

The term "asphaltene" shall refer to materials in a heavy oil feedstock that are typically insoluble in paraffinic solvents such as propane, butane, pentane, hexane, and heptane. Asphaltenes can include sheets of condensed ring compounds held together by hetero atoms such as sulfur, nitrogen, oxygen and metals. Asphaltenes broadly include a wide range of complex compounds having anywhere from 80 to 1200 carbon atoms, with predominating molecular weights, as determined by solution techniques, in the 1200 to 16,900 range. About 80-90% of the metals in the crude oil are contained in the asphaltene fraction which, together with a higher concentration of non-metallic hetero atoms, renders the asphaltene molecules more hydrophilic and less hydrophobic than other hydrocarbons in crude. A hypothetical asphaltene molecule structure developed by A.G. Bridge and co-workers at Chevron is depicted in FIG. 1. Generally, asphaltenes are typically defined based on the results of insolubles methods, and more than one definition of asphaltenes may be used. Specifically, a commonly used definition of asphaltenes is heptane insolubles minus toluene insolubles (i.e., asphaltenes are soluble in toluene; sediments and residues insoluble in toluene are not counted as asphaltenes). Asphaltenes defined in this fashion may be referred to as "$C_7$ asphaltenes". However, an alternate definition may also be used with equal validity, measured as pentane insolubles minus toluene insolubles, and commonly referred to as "$C_5$ asphaltenes". In the examples of the present invention, the $C_7$ asphaltene definition is used, but the $C_5$ asphaltene definition can be readily substituted.

The "quality" of heavy oil is measured by at least one characteristic selected from, but not limited to: (i) boiling point; (ii) concentration of sulfur; (iii) concentration of nitrogen; (iv) concentration of metals; (v) molecular weight; (vi) hydrogen to carbon ratio; (vii) asphaltene content; and (viii) sediment forming tendency.

A "lower quality heavy oil" and/or "lower quality feedstock blend" will have at least one lower quality characteristic compared to an initial heavy oil feedstock selected from, but not limited to: (i) higher boiling point; (ii) higher concentration of sulfur; (iii) higher concentration of nitrogen; (iv) higher concentration of metals; (v) higher molecular weight (often indicated by higher density and viscosity); (vi) lower hydrogen to carbon ratio; (vii) higher asphaltene content; and (viii) greater sediment forming tendency.

The term "opportunity feedstock" refers to lower quality heavy oils and lower quality heavy oil feedstock blends having at least one lower quality characteristic compared to an initial heavy oil feedstock.

The terms "hydrocracking" and "hydroconversion" shall refer to a process whose primary purpose is to reduce the boiling range of a heavy oil feedstock and in which a substantial portion of the feedstock is converted into products with boiling ranges lower than that of the original feedstock. Hydrocracking or hydroconversion generally involves fragmentation of larger hydrocarbon molecules into smaller molecular fragments having a fewer number of carbon atoms and a higher hydrogen-to-carbon ratio. The mechanism by which hydrocracking occurs typically involves the formation of hydrocarbon free radicals during thermal fragmentation, followed by capping of the free radical ends or moieties with hydrogen. The hydrogen atoms or radicals that react with hydrocarbon free radicals during hydrocracking can be generated at or by active catalyst sites.

The term "hydrotreating" shall refer to operations whose primary purpose is to remove impurities such as sulfur, nitrogen, oxygen, halides, and trace metals from the feedstock and saturate olefins and/or stabilize hydrocarbon free radicals by reacting them with hydrogen rather than allowing them to react with themselves. The primary purpose is not to change the boiling range of the feedstock. Hydrotreating is most often carried out using a fixed bed reactor, although other hydroprocessing reactors can also be used for hydrotreating, an example of which is an ebullated bed hydrotreater.

Of course, "hydrocracking" or "hydroconversion" may also involve the removal of sulfur and nitrogen from a feedstock as well as olefin saturation and other reactions typically associated with "hydrotreating". The terms "hydroprocessing" and "hydroconversion" shall broadly refer to both "hydrocracking" and "hydrotreating" processes, which define opposite ends of a spectrum, and everything in between along the spectrum.

The term "hydrocracking reactor" shall refer to any vessel in which hydrocracking (i.e., reducing the boiling range) of a feedstock in the presence of hydrogen and a hydrocracking catalyst is the primary purpose. Hydrocracking reactors are characterized as having an inlet port into which a heavy oil feedstock and hydrogen can be introduced, an outlet port from which an upgraded feedstock or material can be withdrawn, and sufficient thermal energy so as to form hydrocarbon free radicals in order to cause fragmentation of larger hydrocarbon molecules into smaller molecules. Examples of hydrocracking reactors include, but are not limited to, slurry phase reactors (i.e., a two phase, gas-liquid system), ebullated bed reactors (i.e., a three phase, gas-liquid-solid system), fixed bed reactors (i.e., a three-phase system that includes a liquid feed trickling downward over or flowing upward through a fixed bed of solid heterogeneous catalyst with hydrogen typically flowing cocurrently, but possibly countercurrently, to the heavy oil).

The term "hydrocracking temperature" shall refer to a minimum temperature required to cause significant hydrocracking of a heavy oil feedstock. In general, hydrocracking temperatures will preferably fall within a range of about 399° C. (750° F.) to about 460° C. (860° F.), more preferably in a range of about 418° C. (785° F.) to about 443° C. (830° F.), and most preferably in a range of about 421° C. (790° F.) to about 440° C. (825° F.).

The term "gas-liquid slurry phase hydrocracking reactor" shall refer to a hydroprocessing reactor that includes a continuous liquid phase and a gaseous dispersed phase which forms a "slurry" of gaseous bubbles within the liquid phase. The liquid phase typically comprises a hydrocarbon feedstock that may contain a low concentration of dispersed metal sulfide catalyst particles, and the gaseous phase typically comprises hydrogen gas, hydrogen sulfide, and vaporized low boiling point hydrocarbon products. The liquid phase can optionally include a hydrogen donor solvent. The term "gas-liquid-solid, 3-phase slurry hydrocracking reactor" is used when a solid catalyst is employed along with liquid and gas. The gas may contain hydrogen, hydrogen sulfide and vaporized low boiling hydrocarbon products. The term "slurry phase reactor" shall broadly refer to both type of reactors (e.g., those with dispersed metal sulfide catalyst particles, those with a micron-sized or larger particulate catalyst, and those that include both).

The terms "solid heterogeneous catalyst", "heterogeneous catalyst" and "supported catalyst" shall refer to catalysts typically used in ebullated bed and fixed bed hydroprocessing systems, including catalysts designed primarily for hydrocracking, hydroconversion, hydrodemetallization, and/or hydrotreating. A heterogeneous catalyst typically comprises: (i) a catalyst support having a large surface area and interconnected channels or pores; and (ii) fine active catalyst particles, such as sulfides of cobalt, nickel, tungsten, and molybdenum dispersed within the channels or pores. The pores of the support are typically of limited size to maintain mechanical integrity of the heterogeneous catalyst and prevent breakdown and formation of excessive fines in the reactor. Heterogeneous catalysts can be produced as cylindrical pellets or spherical solids.

The terms "dispersed metal sulfide catalyst particles" and "dispersed catalyst" shall refer to catalyst particles having a particle size that is less than 1 μm e.g., less than about 500 nm in diameter, or less than about 250 nm in diameter, or less than about 100 nm in diameter, or less than about 50 nm in diameter, or less than about 25 nm in diameter, or less than about 10 nm in diameter, or less than about 5 nm in diameter. The term "dispersed metal sulfide catalyst particles" may include molecular or molecularly-dispersed catalyst compounds.

The term "molecularly-dispersed catalyst" shall refer to catalyst compounds that are essentially "dissolved" or dissociated from other catalyst compounds or molecules in a hydrocarbon feedstock or suitable diluent. It can include very small catalyst particles that contain a few catalyst molecules joined together (e.g., 15 molecules or less).

The terms "residual catalyst particles" shall refer to catalyst particles that remain with an upgraded material when transferred from one vessel to another (e.g., from a hydroprocessing reactor to a separator and/or other hydroprocessing reactor).

The term "conditioned feedstock" shall refer to a hydrocarbon feedstock into which a catalyst precursor has been combined and mixed sufficiently so that, upon decomposition of the catalyst precursor and formation of the active catalyst, the catalyst will comprise dispersed metal sulfide catalyst particles formed in situ within the feedstock.

The terms "upgrade", "upgrading" and "upgraded", when used to describe a feedstock that is being or has been subjected to hydroprocessing, or a resulting material or product, shall refer to one or more of a reduction in the molecular weight of the feedstock, a reduction in the boiling point range of the feedstock, a reduction in the concentration of asphaltenes, a reduction in the concentration of hydrocarbon free radicals, and/or a reduction in the quantity of impurities, such as sulfur, nitrogen, oxygen, halides, and metals.

The term "severity" generally refers to the amount of energy that is introduced into heavy oil during hydroprocessing and is often related to the operating temperature of the hydroprocessing reactor (i.e., higher temperature is related to higher severity; lower temperature is related to lower severity) in combination with the duration of said temperature exposure. Increased severity generally increases the quantity of conversion products produced by the hydroprocessing reactor, including both desirable products and undesirable conversion products. Desirable conversion products include hydrocarbons of reduced molecular weight, boiling point, and specific gravity, which can include end products such as naphtha, diesel, jet fuel, kerosene, wax, fuel oil, and the like. Other desirable conversion products include higher boiling hydrocarbons that can be further processed using conventional refining and/or distillation processes. Undesirable conversion products include coke, sediment, metals, and other solid materials that can deposit on hydroprocessing equipment and cause fouling, such as interior components of reactors, separators, filters, pipes, towers, and the heterogeneous catalyst. Undesirable conversion products can also refer to unconverted resid that remains after distillation, such as atmospheric tower bottoms ("ATB") or vacuum tower bottoms ("VTB"). Minimizing undesirable conversion products reduces equipment fouling and shutdowns required to clean the equipment. Nevertheless, there may be a desirable amount of unconverted resid in order for downstream separation equipment to function properly and/or in order to provide a liquid transport medium for containing coke, sediment, metals, and other solid materials that might otherwise deposit on and foul equipment but that can be transported away by the remaining resid.

In addition to temperature, "severity" can be related to one or both of "conversion" and "throughput". Whether increased severity involves increased conversion and/or increased or decreased throughput may depend on the quality of the heavy oil feedstock and/or the mass balance of the overall hydroprocessing system. For example, where it is desired to convert a greater quantity of feed material and/or provide a greater quantity of material to downstream equipment, increased severity may primarily involve increased throughput without necessarily increasing fractional conversion. This can include the case where resid fractions (ATB and/or VTB) are sold as fuel oil and increased conversion without increased throughput might decrease the quantity of this product. In the case where it is desired to increase the ratio of upgraded materials to resid fractions, it may be desirable to primarily increase conversion without necessarily increasing throughput. Where the quality of heavy oil introduced into the hydroprocessing reactor fluctuates, it may be desirable to selectively increase or decrease one or both of conversion and throughput to maintain a desired ratio of upgraded materials to resid fractions and/or a desired absolute quantity or quantities of end product(s) being produced.

The terms "conversion" and "fractional conversion" refer to the proportion, often expressed as a percentage, of heavy oil that is beneficially converted into lower boiling and/or lower molecular weight materials. The conversion is expressed as a percentage of the initial resid content (i.e. components with boiling point greater than a defined residue cut point) which is converted to products with boiling point less than the defined cut point. The definition of residue cut point can vary, and can nominally include 524° C. (975° F.), 538° C. (1000° F.), 565° C. (1050° F.), and the like. It can be measured by distillation analysis of feed and product streams to determine the concentration of components with boiling point greater than the defined cut point. Fractional conversion is expressed as (F−P)/F, where F is the quantity of resid in the combined feed streams, and P is the quantity in the combined product streams, where both feed and product resid content are based on the same cut point definition. The quantity of resid is most often defined based on the mass of components with boiling point greater than the defined cut point, but volumetric or molar definitions could also be used.

The term "throughput" refers to the quantity of feed material that is introduced into the hydroprocessing reactor as a function of time. It is also related to the total quantity of conversion products removed from the hydroprocessing reactor, including the combined amounts of desirable and undesirable products. Throughput can be expressed in volumetric terms, such as barrels per day, or in mass terms, such as metric tons per hour. In common usage, throughput is defined as the mass or volumetric feed rate of only the heavy oil feedstock itself (for example, vacuum tower bottoms or the like). The definition does not normally include quantities of diluents or other components that may sometimes be included in the overall feeds to a hydroconversion unit, although a definition which includes those other components could also be used.

The term "sediment" refers to solids contained in a liquid stream that can settle out. Sediments can include inorganics, coke, or insoluble asphaltenes that precipitate on cooling after conversion. Sediment in petroleum products is commonly measured using the IP-375 hot filtration test procedure for total sediment in residual fuel oils published as part of ISO 10307 and ASTM D4870. Other tests include the IP-390 sediment test and the Shell hot filtration test. Sediment is related to components of the oil that have a propensity for forming solids during processing and handling. These solid-forming components have multiple undesirable effects in a hydroconversion process, including degradation of product quality and operability problems related to fouling. It should be noted that although the strict definition of sediment is based on the measurement of solids in a sediment test, it is common for the term to be used more loosely to refer to the solids-forming components of the oil itself.

The term "fouling" refers to the formation of an undesirable phase (foulant) that interferes with processing. The foulant is normally a carbonaceous material or solid that deposits and collects within the processing equipment. Fouling can result in loss of production due to equipment shutdown, decreased performance of equipment, increased energy consumption due to the insulating effect of foulant deposits in heat exchangers or heaters, increased maintenance costs for equipment cleaning, reduced efficiency of fractionators, and reduced reactivity of heterogeneous catalyst.

II. Ebullated Bed Hydroprocessing Reactors and Systems

FIGS. 2A-2D schematically depict non-limiting examples of ebullated bed hydroprocessing reactors and systems used to hydroprocess hydrocarbon feedstocks such as heavy oil, which can be upgraded to use a dual catalyst system according to the invention. It will be appreciated that the example ebullated bed hydroprocessing reactors and systems can include interstage separation, integrated hydrotreating, and/or integrated hydrocracking.

Figure 2A:
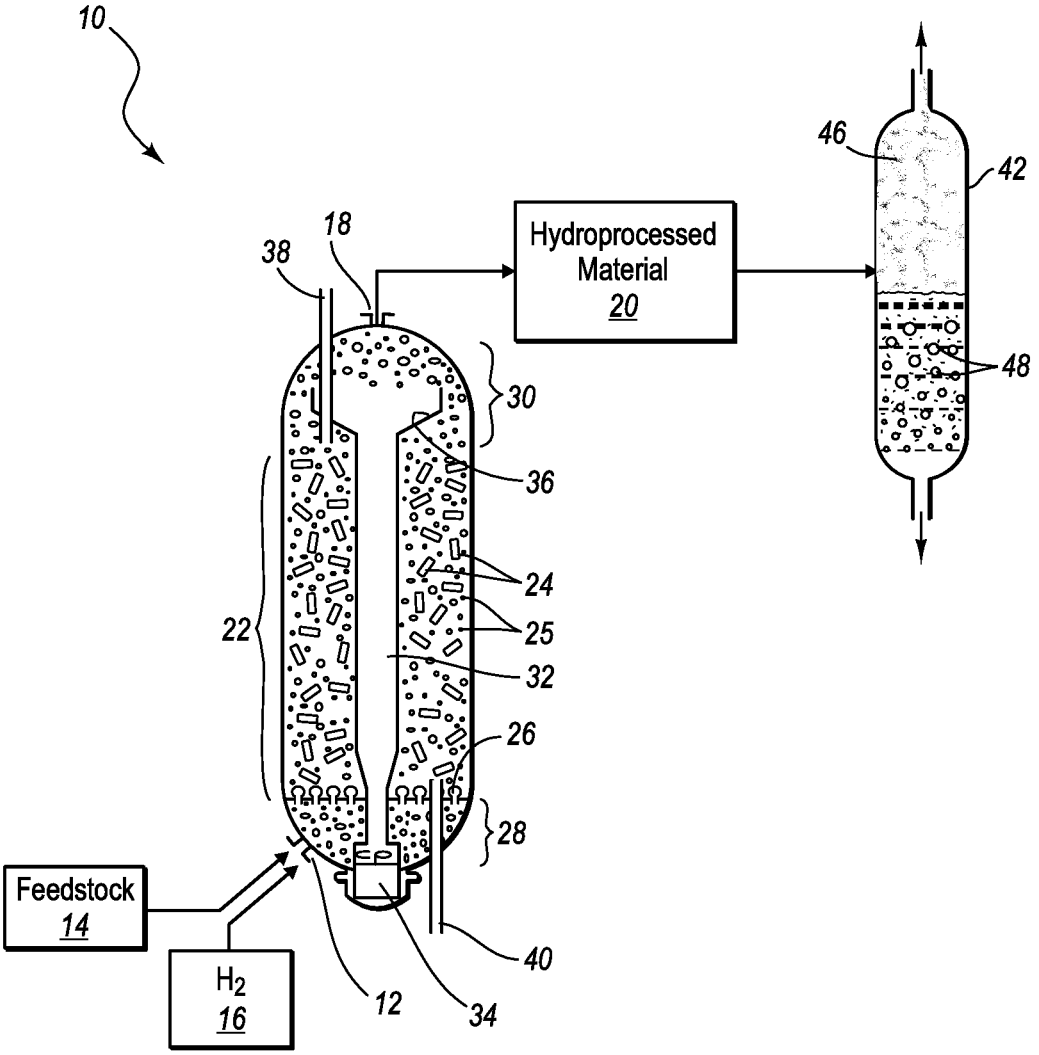
FIGS. 2A and 2B schematically illustrate exemplary ebullated bed reactors.

FIG. 2A schematically illustrates an ebullated bed hydroprocessing reactor 10 used in the LC-Fining hydrocracking system developed by C-E Lummus. Ebullated bed reactor 10 includes an inlet port 12 near the bottom, through which a feedstock 14 and pressurized hydrogen gas 16 are introduced, and an outlet port 18 at the top, through which hydroprocessed material 20 is withdrawn.

Reactor 10 further includes an expanded catalyst zone 22 comprising a heterogeneous catalyst 24 that is maintained in an expanded or fluidized state against the force of gravity by upward movement of liquid hydrocarbons and gas (schematically depicted as bubbles 25) through ebullated bed reactor 10. The lower end of expanded catalyst zone 22 is defined by a distributor grid plate 26, which separates expanded catalyst zone 22 from a lower heterogeneous catalyst free zone 28 located between the bottom of ebullated bed reactor 10 and distributor grid plate 26. Distributor grid plate 26 is configured to distribute the hydrogen gas and hydrocarbons evenly across the reactor and prevents heterogeneous catalyst 24 from falling by the force of gravity into lower heterogeneous catalyst free zone 28. The upper end of the expanded catalyst zone 22 is the height at which the downward force of gravity begins to equal or exceed the uplifting force of the upwardly moving feedstock and gas through ebullated bed reactor 10 as heterogeneous catalyst 24 reaches a given level of expansion or separation. Above expanded catalyst zone 22 is an upper heterogeneous catalyst free zone 30.

Hydrocarbons and other materials within the ebullated bed reactor 10 are continuously recirculated from upper heterogeneous catalyst free zone 30 to lower heterogeneous catalyst free zone 28 by means of a recycling channel 32 positioned in the center of ebullated bed reactor 10 connected to an ebullating pump 34 at the bottom of ebullated bed reactor 10. At the top of recycling channel 32 is a funnel-shaped recycle cup 36 through which feedstock is drawn from upper heterogeneous catalyst free zone 30.

Material drawn downward through recycling channel 32 enters lower catalyst free zone 28 and then passes upwardly through distributor grid plate 26 and into expanded catalyst zone 22, where it is blended with freshly added feedstock 14 and hydrogen gas 16 entering ebullated bed reactor 10 through inlet port 12. Continuously circulating blended materials upward through the ebullated bed reactor 10 advantageously maintains heterogeneous catalyst 24 in an expanded or fluidized state within expanded catalyst zone 22, minimizes channeling, controls reaction rates, and keeps heat released by the exothermic hydrogenation reactions to a safe level.

Fresh heterogeneous catalyst 24 is introduced into ebullated bed reactor 10, such as expanded catalyst zone 22, through a catalyst inlet tube 38, which passes through the top of ebullated bed reactor 10 and directly into expanded catalyst zone 22. Spent heterogeneous catalyst 24 is withdrawn from expanded catalyst zone 22 through a catalyst withdrawal tube 40 that passes from a lower end of expanded catalyst zone 22 through distributor grid plate 26 and the bottom of ebullated bed reactor 10. It will be appreciated that the catalyst withdrawal tube 40 is unable to differentiate between fully spent catalyst, partially spent but active catalyst, and freshly added catalyst such that a random distribution of heterogeneous catalyst 24 is typically withdrawn from ebullated bed reactor 10 as "spent" catalyst.

Upgraded material 20 withdrawn from ebullated bed reactor 10 can be introduced into a separator 42 (e.g., hot separator, inter-stage pressure differential separator, or distillation tower). The separator 42 separates one or more volatile fractions 46 from a non-volatile fraction 48.

Figure 2B:
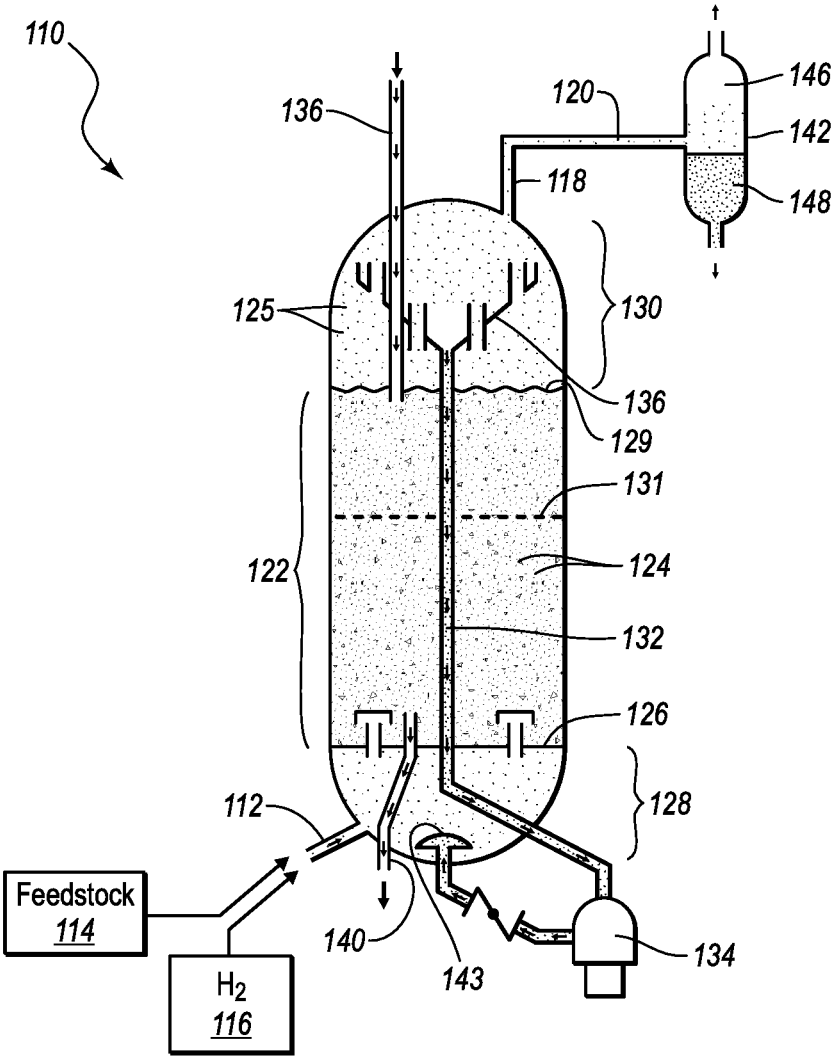

FIG. 2B schematically illustrates an ebullated bed reactor 110 used in the H-Oil hydrocracking system developed by Hydrocarbon Research Incorporated and currently licensed by Axens. Ebullated bed reactor 110 includes an inlet port 112, through which a heavy oil feedstock 114 and pressurized hydrogen gas 116 are introduced, and an outlet port 118, through which upgraded material 120 is withdrawn. An expanded catalyst zone 122 comprising a heterogeneous catalyst 124 is bounded by a distributor grid plate 126, which separates expanded catalyst zone 122 from a lower catalyst free zone 128 between the bottom of reactor 110 and distributor grid plate 126, and an upper end 129, which defines an approximate boundary between expanded catalyst zone 122 and an upper catalyst free zone 130. Dotted boundary line 131 schematically illustrates the approximate level of heterogeneous catalyst 124 when not in an expanded or fluidized state.

Materials are continuously recirculated within reactor 110 by a recycling channel 132 connected to an ebullating pump 134 positioned outside of reactor 110. Materials are drawn through a funnel-shaped recycle cup 136 from upper catalyst free zone 130. Recycle cup 136 is spiral-shaped, which helps separate hydrogen bubbles 125 from recycles material 132 to prevent cavitation of ebullating pump 134. Recycled material 132 enters lower catalyst free zone 128, where it is blended with fresh feedstock 116 and hydrogen gas 118, and the mixture passes up through distributor grid plate 126 and into expanded catalyst zone 122. Fresh catalyst 124 is introduced into expanded catalyst zone 122 through a catalyst inlet tube 136, and spent catalyst 124 is withdrawn from expanded catalyst zone 122 through a catalyst discharge tube 140.

The main difference between the H-Oil ebullated bed reactor 110 and the LC-Fining ebullated bed reactor 10 is the location of the ebullating pump. Ebullating pump 134 in H-Oil reactor 110 is located external to the reaction chamber. The recirculating feedstock is introduced through a recirculation port 141 at the bottom of reactor 110. The recirculation port 141 includes a distributor 143, which aids in evenly distributing materials through lower catalyst free zone 128. Upgraded material 120 is shown being sent to a separator 142, which separates one or more volatile fractions 146 from a non-volatile fraction 148.

Figure 2C:
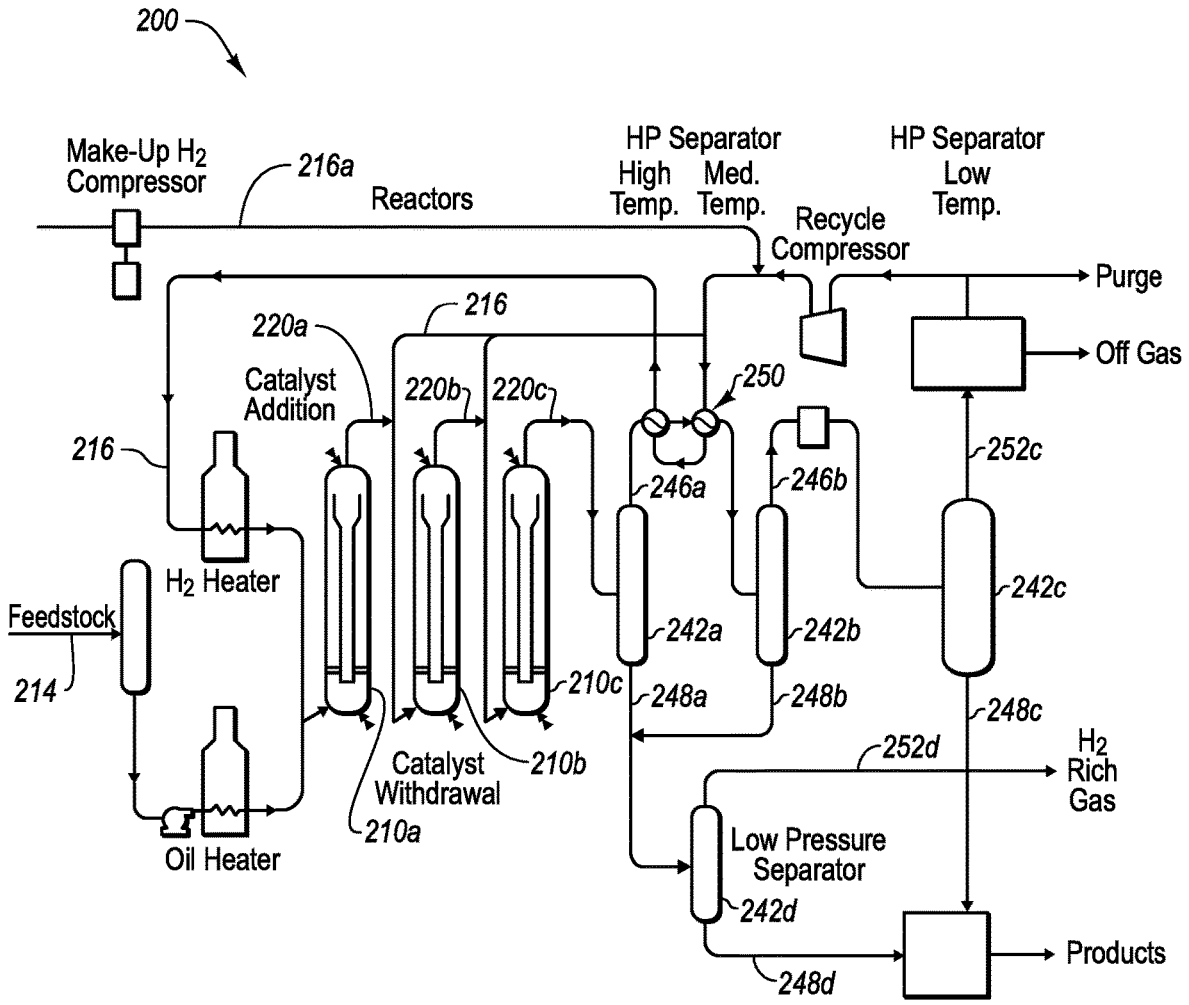
FIG. 2C schematically illustrates an exemplary ebullated bed hydroprocessing system comprising multiple ebullated bed reactors.

FIG. 2C schematically illustrates an ebullated bed hydroprocessing system 200 comprising multiple ebullated bed reactors. Hydroprocessing system 200, an example of which is an LC-Fining hydroprocessing unit, may include three ebullated bed reactors 210 in series for upgrading a feedstock 214. Feedstock 214 is introduced into a first ebullated bed reactor 210*a* together with hydrogen gas 216, both of which are passed through respective heaters prior to entering the reactor. Upgraded material 220*a* from first ebullated bed reactor 210*a* is introduced together with additional hydrogen gas 216 into a second ebullated bed reactor 210*b*. Upgraded material 220*b* from second ebullated bed reactor 210*b* is introduced together with additional hydrogen gas 216 into a third ebullated bed reactor 210*c*.

It should be understood that one or more interstage separators can optionally be interposed between first and second reactors 210*a*, 210*b* and/or second and third reactors 210*b*, 210*c*, in order to remove lower boiling fractions and gases from a non-volatile fraction containing liquid hydrocarbons and residual dispersed metal sulfide catalyst particles. It can be desirable to remove lower alkanes, such as hexanes and heptanes, which are valuable fuel products but poor solvents for asphaltenes. Removing volatile materials between multiple reactors enhances production of valuable products and increases the solubility of asphaltenes in the hydrocarbon liquid fraction fed to the downstream reactor(s). Both increase efficiency of the overall hydroprocessing system.

Upgraded material 220*c* from third ebullated bed reactor 210*c* is sent to a high temperature separator 242*a*, which separates volatile and non-volatile fractions. Volatile fraction 246*a* passes through a heat exchanger 250, which preheats hydrogen gas 216 prior to being introduced into first ebullated bed reactor 210*a*. The somewhat cooled volatile fraction 246*a* is sent to a medium temperature separator 242*b*, which separates a remaining volatile fraction 246*b* from a resulting liquid fraction 248*b* that forms as a result of cooling by heat exchanger 250. Remaining volatile fraction 246*b* is sent downstream to a low temperature separator 246*c* for further separation into a gaseous fraction 252*c* and a degassed liquid fraction 248*c*.

A liquid fraction 248*a* from high temperature separator 242*a* is sent together with resulting liquid fraction 248*b* from medium temperature separator 242*b* to a low pressure separator 242*d*, which separates a hydrogen rich gas 252*d* from a degassed liquid fraction 248*d*, which is then mixed with the degassed liquid fraction 248*c* from low temperature separator 242*c* and fractionated into products. Gaseous fraction 252*c* from low temperature separator 242*c* is purified into off gas, purge gas, and hydrogen gas 216. Hydrogen gas 216 is compressed, mixed with make-up hydrogen gas 216*a*, and either passed through heat exchanger 250 and introduced into first ebullated bed reactor 210*a* together with feedstock 216 or introduced directly into second and third ebullated bed reactors 210*b* and 210*b*.

Figure 2D:
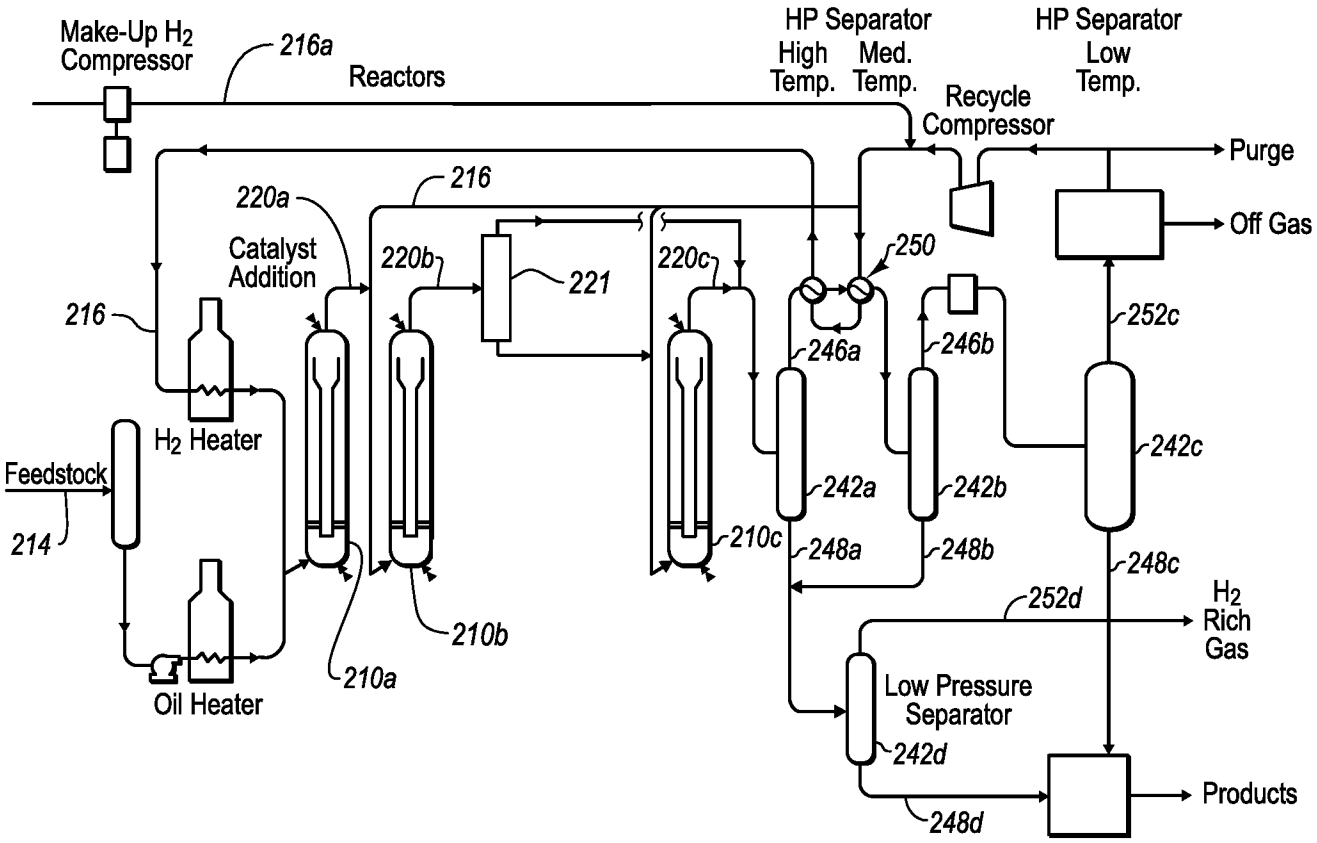
FIG. 2D schematically illustrates an exemplary ebullated bed hydroprocessing system comprising multiple ebullated bed reactors and an interstage separator between two of the reactors.

FIG. 2D schematically illustrates an ebullated bed hydroprocessing system 200 comprising multiple ebullated bed reactors, similar to the system illustrated in FIG. 2C, but showing an interstage separator 221 interposed between second and third reactors 210*b*, 210*c* (although interstage separator 221 may be interposed between first and second reactors 210*a*, 210*b*). As illustrated, the effluent from second-stage reactor 210*b* enters interstage separator 221, which can be a high-pressure, high-temperature separator. The liquid fraction from separator 221 is combined with a portion of the recycle hydrogen from line 216 and then enters third-stage reactor 210*c*. The vapor fraction from the interstage separator 221 bypasses third-stage reactor 210*c*, mixes with effluent from third-stage reactor 210*c*, and then passes into a high-pressure, high-temperature separator 242*a*.

This allows lighter, more-saturated components formed in the first two reactor stages to bypass third-stage reactor 210*c*. The benefits of this are (1) a reduced vapor load on the third-stage reactor, which increases the volume utilization of the third-stage reactor for converting the remaining heavy components, and (2) a reduced concentration of "anti-solvent" components (saturates) which can destabilize asphaltenes in third-stage reactor 210*c*.

In preferred embodiments, the hydroprocessing systems are configured and operated to promote hydrocracking reactions rather than mere hydrotreating, which is a less severe form of hydroprocessing. Hydrocracking involves the breaking of carbon-carbon molecular bonds, such as reducing the molecular weight of larger hydrocarbon molecules and/or ring opening of aromatic compounds. Hydrotreating, on the other hand, mainly involves hydrogenation of unsaturated hydrocarbons, with minimal or no breaking of carbon-carbon molecular bonds. To promote hydrocracking rather than mere hydrotreating reactions, the hydroprocessing reactor(s) are preferably operated at a temperature in a range of about 750° F. (399° C.) to about 860° F. (460° C.), more preferably in a range of about 780° F. (416° C.) to about 830° F. (443° C.), are preferably operated at a pressure in a range of about 1000 psig (6.9 MPa) to about 3000 psig (20.7 MPa), more preferably in a range of about 1500 psig (10.3 MPa) to about 2500 psig (17.2 MPa), and are preferably operated at a space velocity (e.g., Liquid Hourly Space Velocity, or LHSV, defined as the ratio of feed volume to reactor volume per hour) in a range of about 0.05 $hr^{-1}$ to about 0.45 $hr^{1}$, more preferably in a range of about 0.15 $hr^{-1}$ to about 0.35 $hr^{-1}$. The difference between hydrocracking and hydrotreating can also be expressed in terms of resid conversion (wherein hydrocracking results in the substantial conversion of higher boiling to lower boiling hydrocarbons, while hydrotreating does not). The hydroprocessing systems disclosed herein can result in a resid conversion in a range of about 40% to about 90%, preferably in a range of about 55% to about 80%. The preferred conversion range typically depends on the type of feedstock because of differences in processing difficulty between different feedstocks. Typically, conversion will be at least about 5%, preferably at least about 10% higher, compared to operating an ebullated bed reactor prior to upgrading to utilize a dual catalyst system as disclosed herein.

III. Upgrading an Ebullated Bed Hydroprocessing Reactor

FIGS. 3A, 3B, 3C, and 3D are flow diagrams which illustrate exemplary methods for upgrading an ebullated bed reactor to use a dual catalyst system and operate with increased reactor severity and increased the rate of production of converted products.

Figure 3A:
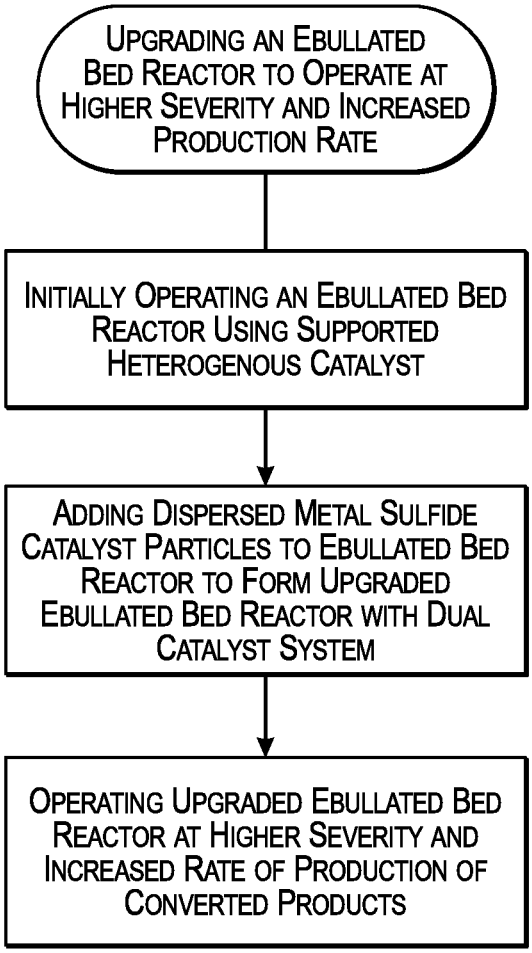
FIG. 3A is a flow diagram illustrating an exemplary method for upgrading an ebullated bed reactor to operate at higher severity and an increased rate of production of converted products.

FIG. 3A more particularly illustrates a method comprising: (1) initially operating an ebullated bed reactor using a heterogeneous catalyst to hydroprocess heavy oil at initial conditions; (2) adding dispersed metal sulfide catalyst particles to the ebullated bed reactor to form an upgraded reactor with a dual catalyst system; and (3) operating the upgraded ebullated bed reactor using the dual catalyst system with increased reactor severity and an increased rate of production of converted products than when operating at the initial conditions.

According to some embodiments, the heterogeneous catalyst utilized when initially operating the ebullated bed reactor at an initial condition is a commercially available catalyst that is typically used in ebullated bed reactors. To maximize efficiency, the initial reactor conditions may advantageously be with a reactor severity at which sediment formation and fouling are maintained within acceptable levels. Increasing reactor severity without upgrading the ebullated reactor to use a dual catalyst system may therefore result in excessive sediment formation and undesirable equipment fouling, which would otherwise require more frequent shutdown and cleaning of the hydroprocessing reactor and related equipment, such as pipes, towers, heaters, heterogeneous catalyst and/or separation equipment.

In order to increase reactor severity and increase the production of converted products without increasing equipment fouling and the need for more frequent shutdown and maintenance, the ebullated bed reactor is upgraded to use a dual catalyst system comprising a heterogeneous catalyst and dispersed metal sulfide catalyst particles. Operating the upgraded ebullated bed reactor with increased severity may include operating with increased conversion and/or increased throughput than when operating at the initial conditions. Both typically involve operating the upgraded reactor at an increased temperature.

In some embodiments, operating the upgraded reactor with increased reactor severity includes increasing the operating temperature of the upgraded ebullated bed reactor by nominally at least about 2.5° C., or at least about 5° C., at least about 7.5° C., or at least about 10° C., or at least about 15° C., than when operating at the initial conditions.

Figure 3B:
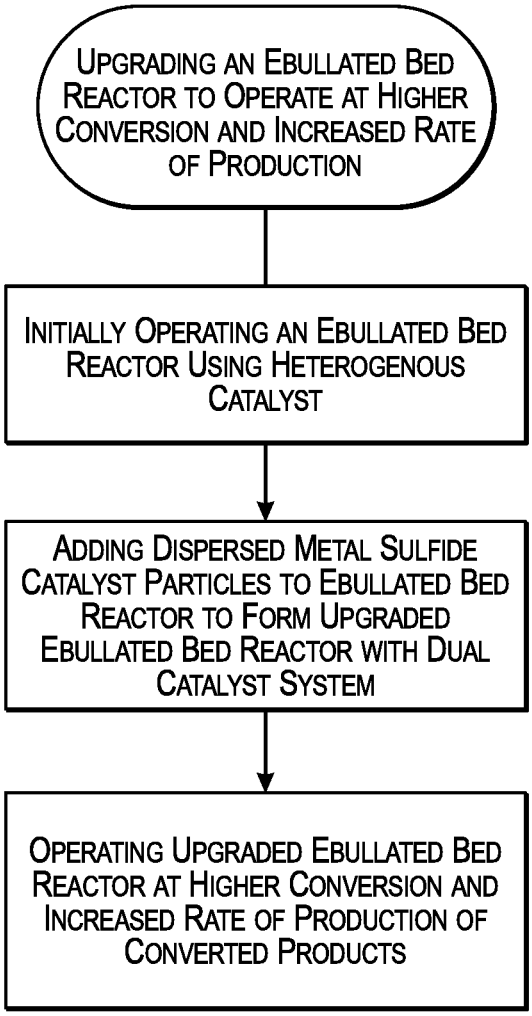
FIG. 3B is a flow diagram illustrating an exemplary method for upgrading an ebullated bed reactor to operate with higher conversion and an increased rate of production of converted products.

FIG. 3B is a flow diagram illustrating an exemplary method for upgrading an ebullated bed reactor to operate with higher conversion and an increased rate of production of converted products. This is an embodiment of the method illustrated in FIG. 3A. FIG. 3B more particularly illustrates a method comprising: (1) initially operating an ebullated bed reactor using a heterogeneous catalyst to hydroprocess heavy oil at initial conditions; (2) adding dispersed metal sulfide catalyst particles to the ebullated bed reactor to form an upgraded reactor with a dual catalyst system; and (3) operating the upgraded ebullated bed reactor using the dual catalyst system with higher conversion and an increased rate of production of converted products than when operating at the initial conditions.

In some embodiments, operating the upgraded reactor with increased conversion includes increasing the conversion of the upgraded ebullated bed reactor by at least about 2.5%, or at least about 5%, at least about 7.5%, or at least about 10%, or at least about 15%, than when operating at the initial conditions.

Figure 3C:
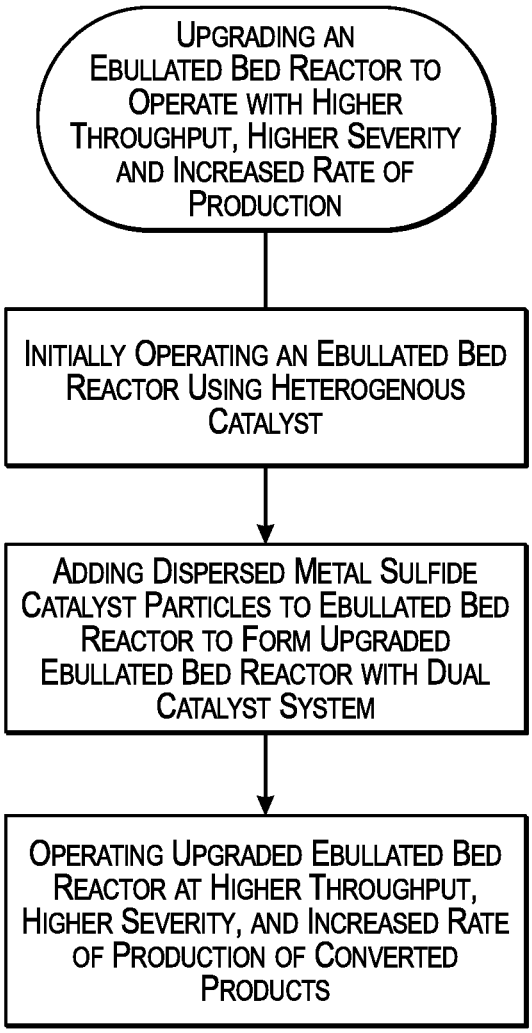
FIG. 3C is a flow diagram illustrating an exemplary method for upgrading an ebullated bed reactor to operate with higher throughput, higher severity, and an increased rate of production of converted products.

FIG. 3C is a flow diagram illustrating an exemplary method for upgrading an ebullated bed reactor to operate with higher throughput, higher severity, and an increased rate of production of converted products. This is an embodiment of the method illustrated in FIG. 3A. FIG. 3C more particularly illustrates a method comprising: (1) initially operating an ebullated bed reactor using a heterogeneous catalyst to hydroprocess heavy oil at initial conditions; (2) adding dispersed metal sulfide catalyst particles to the ebullated bed reactor to form an upgraded reactor with a dual catalyst system; and (3) operating the upgraded ebullated bed reactor using the dual catalyst system with higher throughput, higher severity, and an increased rate of production of converted products than when operating at the initial conditions.

In some embodiments, operating the upgraded reactor with increased throughput includes increasing the throughput of the upgraded ebullated bed reactor by at least about 2.5%, or at least about 5%, or at least about 10%, or at least about 15%, or at least about 20% (e.g., 24%), than when operating at the initial conditions.

Figure 3D:
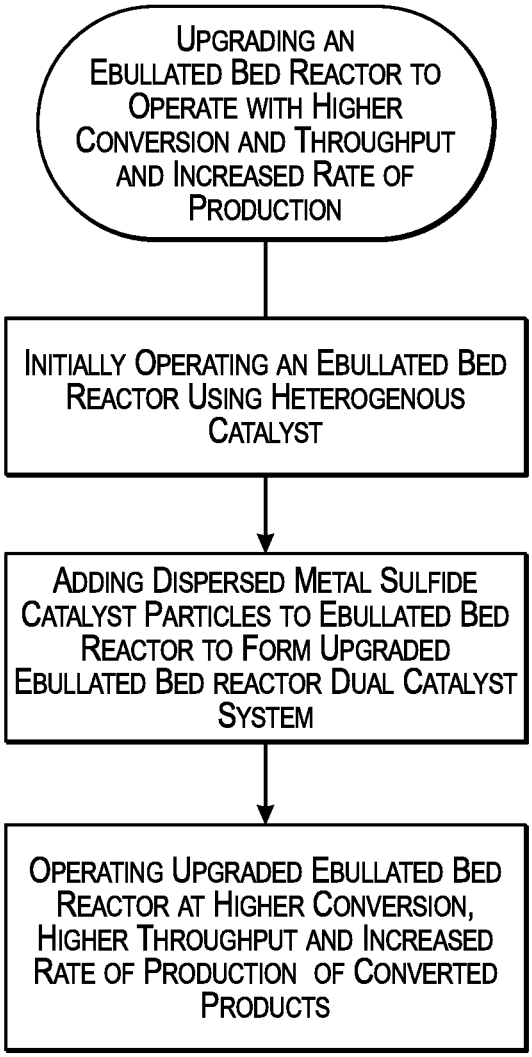
FIG. 3D is a flow diagram illustrating an exemplary method for upgrading an ebullated bed reactor to operate with higher conversion and throughput and an increased rate of production of converted products.

FIG. 3D is a flow diagram illustrating an exemplary method for upgrading an ebullated bed reactor to operate with higher conversion, higher throughput, and an increased rate of production of converted products. This is an embodiment of the method illustrated in FIG. 3A. FIG. 3D more particularly illustrates a method comprising: (1) initially operating an ebullated bed reactor using a heterogeneous catalyst to hydroprocess heavy oil at initial conditions; (2) adding dispersed metal sulfide catalyst particles to the ebullated bed reactor to form an upgraded reactor with a dual catalyst system; and (3) operating the upgraded ebullated bed reactor using the dual catalyst system with higher conversion, higher throughput and an increased rate of production of converted products than when operating at the initial conditions.

In some embodiments, operating the upgraded reactor with increased conversion and throughput includes increasing the conversion of the upgraded ebullated bed reactor by at least about 2.5%, or at least about 5%, at least about 7.5%, or at least about 10%, or at least about 15%, and also increasing the throughput by at least about 2.5%, or at least about 5%, at least about 10%, or at least about 15%, or at least about 20%, than when operating at the initial conditions.

The dispersed metal sulfide catalyst particles can be generated separately and then added to the ebullated bed reactor when forming the dual catalyst system. Alternatively or in addition, at least a portion of the dispersed metal sulfide catalyst particles can be generated in situ within the ebullated bed reactor.

In some embodiments, the dispersed metal sulfide catalyst particles are advantageously formed in situ within an entirety of a heavy oil feedstock. This can be accomplished by initially mixing a catalyst precursor with an entirety of the heavy oil feedstock to form a conditioned feedstock and therefore heating the conditioned feedstock to decompose the catalyst precursor and cause or allow catalyst metal to react with sulfur in and/or added to the heavy oil to form the dispersed metal sulfide catalyst particles.

The catalyst precursor can be oil soluble and have a decomposition temperature in a range from about 100° C. (212° F.) to about 350° C. (662° F.), or in a range of about 150° C. (302° F.) to about 300° C. (572° F.), or in a range of about 175° C. (347° F.) to about 250° C. (482° F.). Example catalyst precursors include organometallic complexes or compounds, more specifically oil soluble compounds or complexes of transition metals and organic acids, having a decomposition temperature or range high enough to avoid substantial decomposition when mixed with a heavy oil feedstock under suitable mixing conditions. When mixing the catalyst precursor with a hydrocarbon oil diluent, it is advantageous to maintain the diluent at a temperature below which significant decomposition of the catalyst precursor occurs. One of skill in the art can, following the present disclosure, select a mixing temperature profile that results in intimate mixing of a selected precursor composition without substantial decomposition prior to formation of the dispersed metal sulfide catalyst particles.

Example catalyst precursors include, but are not limited to, molybdenum 2-ethylhexanoate, molybdenum octoate, molybdenum naphthanate, vanadium naphthanate, vanadium octoate, molybdenum hexacarbonyl, vanadium hexacarbonyl, and iron pentacarbonyl. Other catalyst precursors include molybdenum salts comprising a plurality of cationic molybdenum atoms and a plurality of carboxylate anions of at least 8 carbon atoms and that are at least one of (a) aromatic, (b) alicyclic, or (c) branched, unsaturated and aliphatic. By way of example, each carboxylate anion may have between 8 and 17 carbon atoms or between 11 and 15 carbon atoms. Examples of carboxylate anions that fit at least one of the foregoing categories include carboxylate anions derived from carboxylic acids selected from the group consisting of 3-cyclopentylpropionic acid, cyclohexanebutyric acid, biphenyl-2-carboxylic acid, 4-heptylbenzoic acid, 5-phenylvaleric acid, geranic acid (3,7-dimethyl-2,6-octadienoic acid), and combinations thereof.

In other embodiments, carboxylate anions for use in making oil soluble, thermally stable, molybdenum catalyst precursor compounds are derived from carboxylic acids selected from the group consisting of 3-cyclopentylpropionic acid, cyclohexanebutyric acid, biphenyl-2-carboxylic acid, 4-heptylbenzoic acid, 5-phenylvaleric acid, geranic acid (3,7-dimethyl-2,6-octadienoic acid), 10-undecenoic acid, dodecanoic acid, and combinations thereof. It has been discovered that molybdenum catalyst precursors made using carboxylate anions derived from the foregoing carboxylic acids possess improved thermal stability.

Catalyst precursors with higher thermal stability can have a first decomposition temperature higher than 210° C., higher than about 225° C., higher than about 230° C., higher than about 240° C., higher than about 275° C., or higher than about 290° C. Such catalyst precursors can have a peak decomposition temperature higher than 250° C., or higher than about 260° C., or higher than about 270° C., or higher than about 280° C., or higher than about 290° C., or higher than about 330° C.

One of skill in the art can, following the present disclosure, select a mixing temperature profile that results in intimate mixing of a selected precursor composition without substantial decomposition prior to formation of the dispersed metal sulfide catalyst particles.

Whereas it is within the scope of the invention to directly blend the catalyst precursor composition with the heavy oil feedstock, care must be taken in such cases to mix the components for a time sufficient to thoroughly blend the precursor composition within the feedstock before substantial decomposition of the precursor composition has occurred. For example, U.S. Pat. No. 5,578,197 to Cyr et al., the disclosure of which is incorporated by reference, describes a method whereby molybdenum 2-ethyl hexanoate was mixed with bitumen vacuum tower residuum for 24 hours before the resulting mixture was heated in a reaction vessel to form the catalyst compound and to effect hydrocracking (see col. 10, lines 4-43). Whereas 24-hour mixing in a testing environment may be entirely acceptable, such long mixing times may make certain industrial operations prohibitively expensive. To ensure thorough mixing of the catalyst precursor within the heavy oil prior to heating to form the active catalyst, a series of mixing steps are performed by different mixing apparatus prior to heating the conditioned feedstock. These may include one or more low shear in-line mixers, followed by one or more high shear mixers, followed by a surge vessel and pump-around system, followed by one or more multi-stage high pressure pumps used to pressurize the feed stream prior to introducing it into a hydroprocessing reactor.

In some embodiments, the conditioned feedstock is preheated using a heating apparatus prior to entering the hydroprocessing reactor in order to form at least a portion of the dispersed metal sulfide catalyst particles in situ within the heavy oil. In other embodiments, the conditioned feedstock is heated or further heated in the hydroprocessing reactor in order to form at least a portion of the dispersed metal sulfide catalyst particles in situ within the heavy oil.

In some embodiments, the dispersed metal sulfide catalyst particles can be formed in a multi-step process. For example, an oil soluble catalyst precursor composition can be premixed with a hydrocarbon diluent to form a diluted precursor mixture. Examples of suitable hydrocarbon diluents include, but are not limited to, vacuum gas oil (which typically has a nominal boiling range of 360-524° C.) (680-975° F.), decant oil or cycle oil (which typically has a nominal boiling range of 360°-550° C.) (680-1022° F.), and gas oil (which typically has a nominal boiling range of 200°-360° C.) (392-680° F.), a portion of the heavy oil feedstock, and other hydrocarbons that nominally boil at a temperature higher than about 200° C.

The ratio of catalyst precursor to hydrocarbon oil diluent used to make the diluted precursor mixture can be in a range of about 1:500 to about 1:1, or in a range of about 1:150 to about 1:2, or in a range of about 1:100 to about 1:5 (e.g., 1:100, 1:50, 1:30, or 1:10).

The amount of catalyst metal (e.g., molybdenum) in the diluted precursor mixture is preferably in a range of about 100 ppm to about 7000 ppm by weight of the diluted precursor mixture, more preferably in a range of about 300 ppm to about 4000 ppm by weight of the diluted precursor mixture.

The catalyst precursor is advantageously mixed with the hydrocarbon diluent below a temperature at which a significant portion of the catalyst precursor composition decomposes. The mixing may be performed at temperature in a range of about 25° C. (77° F.) to about 250° C. (482° F.), or in range of about 50° C. (122° F.) to about 200° C. (392° F.), or in a range of about 75° C. (167° F.) to about 150° C. (302° F.), to form the diluted precursor mixture. The temperature at which the diluted precursor mixture is formed may depend on the decomposition temperature and/or other characteristics of the catalyst precursor that is utilized and/or characteristics of the hydrocarbon diluent, such as viscosity.

The catalyst precursor is preferably mixed with the hydrocarbon oil diluent for a time period in a range of about 0.1 second to about 5 minutes, or in a range of about 0.5 second to about 3 minutes, or in a range of about 1 second to about 1 minute. The actual mixing time is dependent, at least in part, on the temperature (i.e., which affects the viscosity of the fluids) and mixing intensity. Mixing intensity is dependent, at least in part, on the number of stages e.g., for an in-line static mixer.

Pre-blending the catalyst precursor with a hydrocarbon diluent to form a diluted precursor mixture which is then blended with the heavy oil feedstock greatly aids in thoroughly and intimately blending the catalyst precursor within the feedstock, particularly in the relatively short period of time required for large-scale industrial operations. Forming a diluted precursor mixture shortens the overall mixing time by (1) reducing or eliminating differences in solubility between a more polar catalyst precursor and a more hydrophobic heavy oil feedstock, (2) reducing or eliminating differences in rheology between the catalyst precursor and heavy oil feedstock, and/or (3) breaking up catalyst precursor molecules to form a solute within the hydrocarbon diluent that is more easily dispersed within the heavy oil feedstock.

The diluted precursor mixture is then combined with the heavy oil feedstock and mixed for a time sufficient and in a manner so as to disperse the catalyst precursor throughout the feedstock to form a conditioned feedstock in which the catalyst precursor is thoroughly mixed within the heavy oil prior to thermal decomposition and formation of the active metal sulfide catalyst particles. In order to obtain sufficient mixing of the catalyst precursor within the heavy oil feedstock, the diluted precursor mixture and heavy oil feedstock are advantageously mixed for a time period in a range of about 0.1 second to about 5 minutes, or in a range from about 0.5 second to about 3 minutes, or in a range of about 1 second to about 3 minutes. Increasing the vigorousness and/or shearing energy of the mixing process generally reduce the time required to effect thorough mixing.

Examples of mixing apparatus that can be used to effect thorough mixing of the catalyst precursor and/or diluted precursor mixture with heavy oil include, but are not limited to, high shear mixing such as mixing created in a vessel with a propeller or turbine impeller; multiple static in-line mixers; multiple static in-line mixers in combination with in-line high shear mixers; multiple static in-line mixers in combination with in-line high shear mixers followed by a surge vessel; combinations of the above followed by one or more multi-stage centrifugal pumps; and one or more multi-stage centrifugal pumps. According some embodiments, continuous rather than batch-wise mixing can be carried out using high energy pumps having multiple chambers within which the catalyst precursor composition and heavy oil feedstock are churned and mixed as part of the pumping process itself. The foregoing mixing apparatus may also be used for the pre-mixing process discussed above in which the catalyst precursor is mixed with the hydrocarbon diluent to form the catalyst precursor mixture.

In the case of heavy oil feedstocks that are solid or extremely viscous at room temperature, such feedstocks may advantageously be heated in order to soften them and create a feedstock having sufficiently low viscosity so as to allow good mixing of the oil soluble catalyst precursor into the feedstock composition. In general, decreasing the viscosity of the heavy oil feedstock will reduce the time required to effect thorough and intimate mixing of the oil soluble precursor composition within the feedstock.

The heavy oil feedstock and catalyst precursor and/or diluted precursor mixture are advantageously mixed at a temperature in a range of about 25° C. (77° F.) to about 350° C. (662° F.), or in a range of about 50° C. (122° F.) to about 300° C. (572° F.), or in a range of about 75° C. (167° F.) to about 250° C. (482° F.) to yield a conditioned feedstock.

In the case where the catalyst precursor is mixed directly with the heavy oil feedstock without first forming a diluted precursor mixture, it may be advantageous to mix the catalyst precursor and heavy oil feedstock below a temperature at which a significant portion of the catalyst precursor composition decomposes. However, in the case where the catalyst precursor is premixed with a hydrocarbon diluent to form a diluted precursor mixture, which is thereafter mixed with the heavy oil feedstock, it may be permissible for the heavy oil feedstock to be at or above the decomposition temperature of the catalyst precursor. That is because the hydrocarbon diluent shields the individual catalyst precursor molecules and prevents them from agglomerating to form larger particles, temporarily insulates the catalyst precursor molecules from heat from the heavy oil during mixing, and facilitates dispersion of the catalyst precursor molecules sufficiently quickly throughout the heavy oil feedstock before decomposing to liberate metal. In addition, additional heating of the feedstock may be necessary to liberate hydrogen sulfide from sulfur-bearing molecules in the heavy oil to form the metal sulfide catalyst particles. In this way, progressive dilution of the catalyst precursor permits a high level of dispersion within the heavy oil feedstock, resulting in the formation of highly dispersed metal sulfide catalyst particles, even where the feedstock is at a temperature above the decomposition temperature of the catalyst precursor.

After the catalyst precursor has been well-mixed throughout the heavy oil to yield a conditioned feedstock, this composition is then heated to cause decomposition of the catalyst precursor to liberate catalyst metal therefrom, cause or allow it to react with sulfur within and/or added to the heavy oil, and form the active metal sulfide catalyst particles. Metal from the catalyst precursor may initially form a metal oxide, which then reacts with sulfur in the heavy oil to yield a metal sulfide compound that forms the final active catalyst. In the case where the heavy oil feedstock includes sufficient or excess sulfur, the final activated catalyst may be formed in situ by heating the heavy oil feedstock to a temperature sufficient to liberate sulfur therefrom. In some cases, sulfur may be liberated at the same temperature that the precursor composition decomposes. In other cases, further heating to a higher temperature may be required.

If the catalyst precursor is thoroughly mixed throughout the heavy oil, at least a substantial portion of the liberated metal ions will be sufficiently sheltered or shielded from other metal ions so that they can form a molecularly-dispersed catalyst upon reacting with sulfur to form the metal sulfide compound. Under some circumstances, minor agglomeration may occur, yielding colloidal-sized catalyst particles. However, it is believed that taking care to thoroughly mix the catalyst precursor throughout the feedstock prior to thermal decomposition of the catalyst precursor may yield individual catalyst molecules rather than colloidal particles. Simply blending, while failing to sufficiently mix, the catalyst precursor with the feedstock typically causes formation of large agglomerated metal sulfide compounds that are micron-sized or larger.

In order to form dispersed metal sulfide catalyst particles, the conditioned feedstock is heated to a temperature in a range of about 275° C. (527° F.) to about 450° C. (842° F.), or in a range of about 310° C. (590° F.) to about 430° C. (806° F.), or in a range of about 330° C. (626° F.) to about 410° C. (770° F.).

The initial concentration of catalyst metal provided by dispersed metal sulfide catalyst particles can be in a range of about 1 ppm to about 500 ppm by weight of the heavy oil feedstock, or in a range of about 5 ppm to about 300 ppm, or in a range of about 10 ppm to about 100 ppm. The catalyst may become more concentrated as volatile fractions are removed from a resid fraction.

In the case where the heavy oil feedstock includes a significant quantity of asphaltene molecules, the dispersed metal sulfide catalyst particles may preferentially associate with, or remain in close proximity to, the asphaltene molecules. Asphaltene molecules can have a greater affinity for the metal sulfide catalyst particles since asphaltene molecules are generally more hydrophilic and less hydrophobic than other hydrocarbons contained within heavy oil. Because the metal sulfide catalyst particles tend to be very hydrophilic, the individual particles or molecules will tend to migrate toward more hydrophilic moieties or molecules within the heavy oil feedstock.

While the highly polar nature of metal sulfide catalyst particles causes or allows them to associate with asphaltene molecules, it is the general incompatibility between the highly polar catalyst compounds and hydrophobic heavy oil that necessitates the aforementioned intimate or thorough mixing of catalyst precursor composition within the heavy oil prior to decomposition and formation of the active catalyst particles. Because metal catalyst compounds are highly polar, they cannot be effectively dispersed within heavy oil if added directly thereto. In practical terms, forming smaller active catalyst particles results in a greater number of catalyst particles that provide more evenly distributed catalyst sites throughout the heavy oil.

IV. Upgraded Ebullated Bed Reactor

Figure 4:
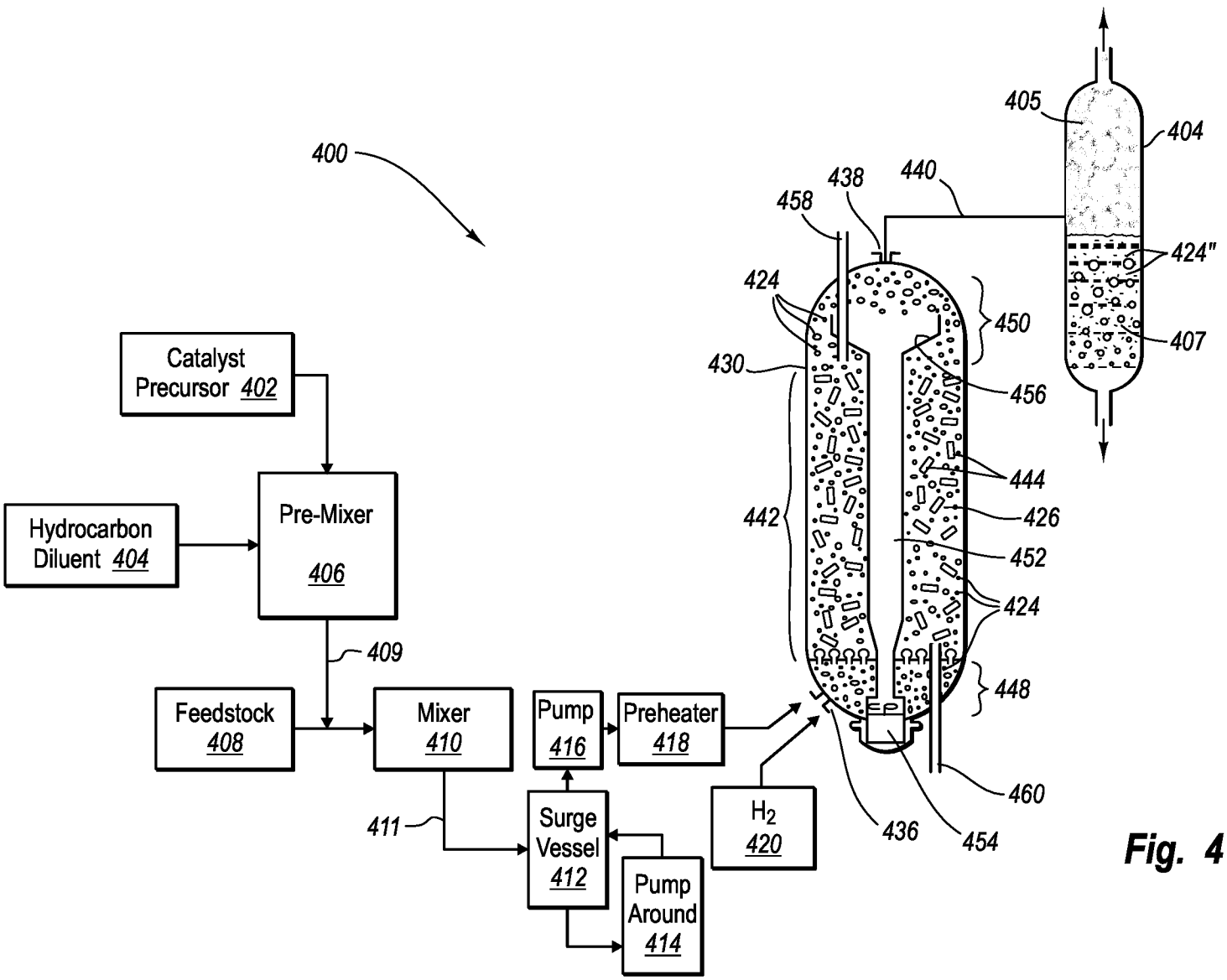
FIG. 4 schematically illustrates an exemplary ebullated bed hydroprocessing system using a dual catalyst system.

FIG. 4 schematically illustrates an example upgraded ebullated bed hydroprocessing system 400 that can be used in the disclosed methods and systems. Ebullated bed hydroprocessing system 400 includes an upgraded ebullated bed reactor 430 and a hot separator 404 (or other separator, such as a distillation tower). To create upgraded ebullated bed reactor 430, a catalyst precursor 402 is initially pre-blended with a hydrocarbon diluent 404 in one or more mixers 406 to form a catalyst precursor mixture 409. Catalyst precursor mixture 409 is added to feedstock 408 and blended with the feedstock in one or more mixers 410 to form conditioned feedstock 411. Conditioned feedstock is fed to a surge vessel 412 with pump around 414 to cause further mixing and dispersion of the catalyst precursor within the conditioned feedstock.

The conditioned feedstock from surge vessel 412 is pressurized by one or more pumps 416, passed through a pre-heater 418, and fed into ebullated bed reactor 430 together with pressurized hydrogen gas 420 through an inlet port 436 located at or near the bottom of ebullated bed reactor 430. Heavy oil material 426 in ebullated bed reactor 430 contains dispersed metal sulfide catalyst particles, schematically depicted as catalyst particles 424.

Heavy oil feedstock 408 may comprise any desired fossil fuel feedstock and/or fraction thereof including, but not limited to, one or more of heavy crude, oil sands bitumen, bottom of the barrel fractions from crude oil, atmospheric tower bottoms, vacuum tower bottoms, coal tar, liquefied coal, and other resid fractions. In some embodiments, heavy oil feedstock 408 can include a significant fraction of high boiling point hydrocarbons (i.e., nominally at or above 343° C. (650° F.), more particularly nominally at or above about 524° C. (975° F.)) and/or asphaltenes. Asphaltenes are complex hydrocarbon molecules that include a relatively low ratio of hydrogen to carbon that is the result of a substantial number of condensed aromatic and naphthenic rings with paraffinic side chains (See FIG. 1). Sheets consisting of the condensed aromatic and naphthenic rings are held together by heteroatoms such as sulfur or nitrogen and/or polymethylene bridges, thio-ether bonds, and vanadium and nickel complexes. The asphaltene fraction also contains a higher content of sulfur and nitrogen than does crude oil or the rest of the vacuum resid, and it also contains higher concentrations of carbon-forming compounds (i.e., that form coke precursors and sediment).

Ebullated bed reactor 430 further includes an expanded catalyst zone 442 comprising a heterogeneous catalyst 444. A lower heterogeneous catalyst free zone 448 is located below expanded catalyst zone 442, and an upper heterogeneous catalyst free zone 450 is located above expanded catalyst zone 442. Dispersed metal sulfide catalyst particles 424 are dispersed throughout material 426 within ebullated bed reactor 430, including expanded catalyst zone 442, heterogeneous catalyst free zones 448, 450, 452 thereby being available to promote upgrading reactions within what constituted catalyst free zones in the ebullated bed reactor prior to being upgraded to include the dual catalyst system.

To promote hydrocracking rather than mere hydrotreating reactions, the hydroprocessing reactor(s) are preferably operated at a temperature in a range of about 750° F. (399° C.) to about 860° F. (460° C.), more preferably in a range of about 780° F. (416° C.) to about 830° F. (443° C.), are preferably operated at a pressure in a range of about 1000 psig (6.9 MPa) to about 3000 psig (20.7 MPa), more preferably in a range of about 1500 psig (10.3 MPa) to about 2500 psig (17.2 MPa), and are preferably operated at a space velocity (LHSV) in a range of about 0.05 $hr^{-1}$ to about 0.45 $hr^{-1}$, more preferably in a range of about 0.15 $hr^{-1}$ to about 0.35 $hr^{-1}$. The difference between hydrocracking and hydrotreating can also be expressed in terms of resid conversion (wherein hydrocracking results in the substantial conversion of higher boiling to lower boiling hydrocarbons, while hydrotreating does not). The hydroprocessing systems disclosed herein can result in a resid conversion in a range of about 40% to about 90%, preferably in a range of about 55% to about 80%. The preferred conversion range typically depends on the type of feedstock because of differences in processing difficulty between different feedstocks. Typically, conversion will be at least about 5%, preferably at least about 10% higher, compared to operating an ebullated bed reactor prior to upgrading to utilize a dual catalyst system as disclosed herein.

Material 426 in ebullated bed reactor 430 is continuously recirculated from upper heterogeneous catalyst free zone 450 to lower heterogeneous catalyst free zone 448 by means of a recycling channel 452 connected to an ebullating pump 454. At the top of recycling channel 452 is a funnel-shaped recycle cup 456 through which material 426 is drawn from upper heterogeneous catalyst free zone 450. Recycled material 426 is blended with fresh conditioned feedstock 411 and hydrogen gas 420.

Fresh heterogeneous catalyst 444 is introduced into ebullated bed reactor 430 through a catalyst inlet tube 458, and spent heterogeneous catalyst 444 is withdrawn through a catalyst withdrawal tube 460. Whereas the catalyst withdrawal tube 460 is unable to differentiate between fully spent catalyst, partially spent but active catalyst, and fresh catalyst, the existence of dispersed metal sulfide catalyst particles 424 provides additional catalytic activity, within expanded catalyst zone 442, recycle channel 452, and lower and upper heterogeneous catalyst free zones 448, 450. The addition of hydrogen to hydrocarbons outside of heterogeneous catalyst 444 minimizes formation of sediment and coke precursors, which are often responsible for deactivating the heterogeneous catalyst.

Ebullated bed reactor 430 further includes an outlet port 438 at or near the top through which converted material 440 is withdrawn. Converted material 440 is introduced into hot separator or distillation tower 404. Hot separator or distillation tower 404 separates one or more volatile fractions 405, which is/are withdrawn from the top of hot separator 404, from a resid fraction 407, which is withdrawn from a bottom of hot separator or distillation tower 404. Resid fraction 407 contains residual metal sulfide catalyst particles, schematically depicted as catalyst particles 424. If desired, at least a portion of resid fraction 407 can be recycled back to ebullated bed reactor 430 in order to form part of the feed material and to supply additional metal sulfide catalyst particles. Alternatively, resid fraction 407 can be further processed using downstream processing equipment, such as another ebullated bed reactor. In that case, separator 404 can be an interstage separator.

In some embodiments, operating the upgraded ebullated bed reactor at a higher reactor severity and an increased rate of production of converted products while using the dual catalyst system results in a rate of equipment fouling that is equal to or less than when initially operating the ebullated bed reactor.

For example, the rate of equipment fouling when operating the upgraded ebullated bed reactor using the dual catalyst system may result in a frequency of heat exchanger shutdowns for cleanout that is equal to or less than when initially operating the ebullated bed reactor.

In addition or alternatively, the rate of equipment fouling when operating the upgraded ebullated bed reactor using the dual catalyst system may result in a frequency of atmospheric and/or vacuum distillation tower shutdowns for cleanout that is equal or less than when initially operating the ebullated bed reactor.

In addition or alternatively, the rate of fouling when operating of the upgraded ebullated bed reactor using the dual catalyst system may result in a frequency of changes or cleaning of filters and strainers that is equal or less than when initially operating the ebullated bed reactor.

In addition or alternatively, the rate of fouling when operating of the upgraded ebullated bed reactor using the dual catalyst system may result in a frequency of switches to spare heat exchangers that is equal or less than when initially operating the ebullated bed reactor.

In addition or alternatively, the rate of fouling when operating of the upgraded ebullated bed reactor using the dual catalyst system may result in a reduced rate of decreasing skin temperatures in equipment selected from one or more of heat exchangers, separators, or distillation towers than when initially operating the ebullated bed reactor.

In addition or alternatively, the rate of fouling when operating of the upgraded ebullated bed reactor using the dual catalyst system may result in a reduced rate of increasing furnace tube metal temperatures than when initially operating the ebullated bed reactor.

In addition or alternatively, the rate of fouling when operating of the upgraded ebullated bed reactor using the dual catalyst system may result in a reduced rate of increasing calculated fouling resistance factors for heat exchangers than when initially operating the ebullated bed reactor.

In some embodiments, operating the upgraded ebullated bed reactor while using the dual catalyst system may result in a rate of sediment production that is equal to or less than when initially operating the ebullated bed reactor. In some embodiments, the rate of sediment production can be based on a measurement of sediment in one or more of: (1) an atmospheric tower bottoms product; (2) a vacuum tower bottoms product; (3) product from a hot low pressure separator; or (4) fuel oil product before or after addition of cutter stocks.

In some embodiments, operating the upgraded ebullated bed reactor while using the dual catalyst system may result in a product sediment concentration that is equal or less than when initially operating the ebullated bed reactor. In some embodiments, the product sediment concentration can be based on a measurement of sediment in one or more of (1) an atmospheric residue product cut and/or an atmospheric tower bottoms product; (2) a vacuum residue product cut and/or a vacuum tower bottoms product; (3) material fed to an atmospheric tower; (4) product from a hot low pressure separator; or (5) fuel oil product before or after addition of one or more cutter stocks.

V. Experimental Studies and Results

Figure 5:
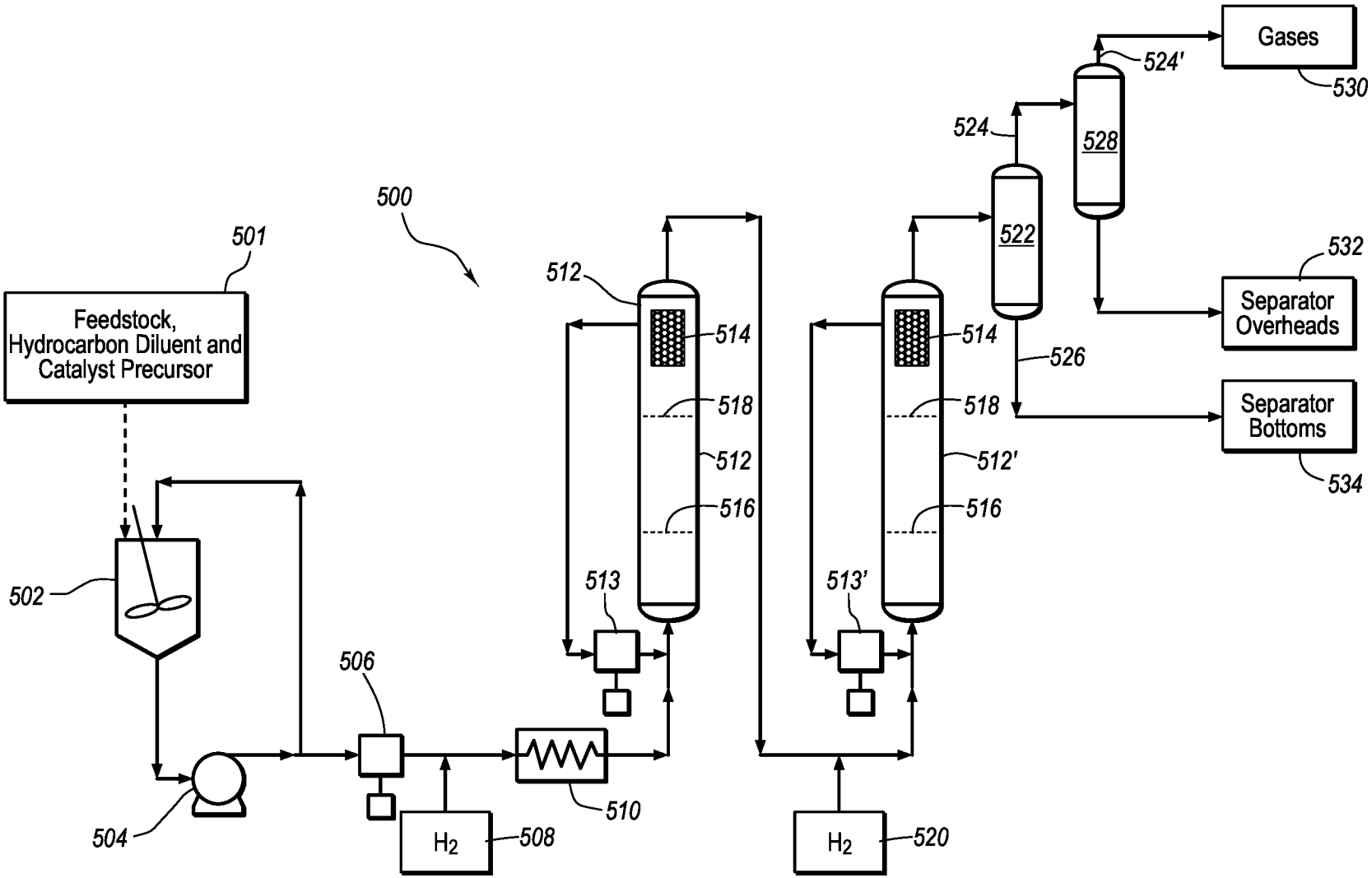
FIG. 5 schematically illustrates a pilot scale ebullated bed hydroprocessing system configured to employ either a heterogeneous catalyst by itself or a dual catalyst system including a heterogeneous catalyst and dispersed metal sulfide particles.

The following test studies demonstrate the effects and advantages of upgrading an ebullated bed reactor to use a dual catalyst system comprised of a heterogeneous catalyst and dispersed metal sulfide catalyst particles when hydroprocessing heavy oil. The pilot plant used for this test was designed according to FIG. 5. As schematically illustrated in FIG. 5, a pilot plant 500 with two ebullated bed reactors 512, 512' connected in series was used to determine the difference between using a heterogeneous catalyst by itself when processing heavy oil feedstocks and a dual catalyst system comprised of a heterogeneous catalyst in combination with dispersed metal sulfide catalyst particles (i.e., dispersed molybdenum disulfide catalyst particles).

For the following test studies, a heavy vacuum gas oil was used as the hydrocarbon diluent. The precursor mixture was prepared by mixing an amount of catalyst precursor with an amount of hydrocarbon diluent to form a catalyst precursor mixture and then mixing an amount of the catalyst precursor mixture with an amount of heavy oil feedstock to achieve the target loading of dispersed catalyst in the conditioned feedstock. As a specific illustration, for one test study with a target loading of 30 ppm dispersed metal sulfide catalyst in the conditioned feedstock (where the loading is expressed based on metal concentration), the catalyst precursor mixture was prepared with a 3000 ppm concentration of metal.

The feedstocks and operating conditions for the actual tests are more particularly identified below. The heterogeneous catalyst was a commercially available catalyst commonly used in ebullated reactors. Note that for comparative test studies for which no dispersed metal sulfide catalyst was used, the hydrocarbon diluent (heavy vacuum gas oil) was added to the heavy oil feedstock in the same proportion as when using a diluted precursor mixture. This ensured that the background composition was the same between tests using the dual catalyst system and those using only the heterogeneous (ebullated bed) catalyst, thereby allowing test results to be compared directly.

Pilot plant 500 more particularly included a high shear mixing vessel 502 for blending a precursor mixture comprised of a hydrocarbon diluent and catalyst precursor (e.g., molybdenum 2-ethylhexanoate) with a heavy oil feedstock (collectively depicted as 501) to form a conditioned feedstock. Proper blending can be achieved by first pre-blending the catalyst precursor with a hydrocarbon diluent to form a precursor mixture.

The conditioned feedstock is recirculated out and back into the mixing vessel 502 by a pump 504, similar to a surge vessel and pump-around. A high precision positive displacement pump 506 draws the conditioned feedstock from the recirculation loop and pressurizes it to the reactor pressure. Hydrogen gas 508 is fed into the pressurized feedstock and the resulting mixture is passed through a pre-heater 510 prior to being introduced into first ebullated bed reactor 512. The pre-heater 510 can cause at least a portion of the catalyst precursor within the conditioned feedstock to decompose and form active catalyst particles in situ within the feedstock.

Each ebullated bed reactor 512, 512' can have a nominal interior volume of about 3000 ml and include a mesh wire guard 514 to keep the heterogeneous catalyst within the reactor. Each reactor is also equipped with a recycle line and recycle pump 513, 513' which provides the required flow velocity in the reactor to expand the heterogeneous catalyst bed. The combined volume of both reactors and their respective recycle lines, all of which are maintained at the specified reactor temperature, can be considered to be the thermal reaction volume of the system and can be used as the basis for calculation of the Liquid Hourly Space Velocity (LHSV). For these examples, "LHSV" is defined as the volume of vacuum residue feedstock fed to the reactor per hour divided by the thermal reaction volume.

A settled height of catalyst in each reactor is schematically indicated by a lower dotted line 516, and the expanded catalyst bed during use is schematically indicated by an upper dotted line 518. A recirculating pump 513 is used to recirculate the material being processed from the top to the bottom of reactor 512 to maintain steady upward flow of material and expansion of the catalyst bed.

Upgraded material from first reactor 512 is transferred together with supplemental hydrogen 520 into second reactor 512' for further hydroprocessing. A second recirculating pump 513' is used to recirculate the material being processed from the top to the bottom of second reactor 512' to maintain steady upward flow of material and expansion of the catalyst bed.

The further upgraded material from second reactor 512' is introduced into a hot separator 522 to separate low-boiling hydrocarbon product vapors and gases 524 from a liquid fraction 526 comprised of unconverted heavy oil. The hydrocarbon product vapors and gases 524 are cooled and pass into a cold separator 528, where they are separated into gases 530 and converted hydrocarbon products, which are recovered as separator overheads 532. The liquid fraction 526 from hot separator 522 is recovered as separator bottoms 534, which can be used for analysis.

Examples 1-4

Examples 1-4 were conducted in the abovementioned pilot plant and tested the ability of an upgraded ebullated bed reactor that employed a dual catalyst system to operate at substantially higher conversion at equal feed rate (throughput) while maintaining or reducing formation of sediment. The increased conversion included higher resid conversion, $C_7$ asphaltene conversion, and micro carbon residue (MCR) conversion. The heavy oil feedstock utilized in this study was Ural vacuum resid (VR). As described above, a conditioned feedstock was prepared by mixing an amount of catalyst precursor mixture with an amount of heavy oil feedstock to a final conditioned feedstock that contained the required amount of dispersed catalyst. The exception to this were tests for which no dispersed catalyst was used, in which case heavy vacuum gas oil was substituted for the catalyst precursor mixture at the same proportion. The conditioned feedstock was fed into the pilot plant system of FIG. 5, which was operated using specific parameters. Relevant process conditions and results are set forth in Table 1.

TABLE 1

| Example # | 1 | 2 | 3 | 4 |
|---|---|---|---|---|
| Feedstock | Ural VR | Ural VR | Ural VR | Ural VR |
| Dispersed Catalyst Conc. | 0 | 0 | 30 | 50 |

TABLE 1-continued

| Example # | 1 | 2 | 3 | 4 |
|---|---|---|---|---|
| Reactor Temperature (° F.) | 789 | 801 | 801 | 801 |
| LHSV, vol. feed/vol. reactor/hr | 0.24 | 0.24 | 0.25 | 0.25 |
| Resid Conversion, based on 1000° F.+, % | 60.0% | 67.7% | 67.0% | 65.9% |
| Product IP-375 Sediment, Separator Bottoms Basis, wt % | 0.78% | 1.22% | 0.76% | 0.54% |
| Product IP-375 Sediment, Feed Oil Basis, wt % | 0.67% | 0.98% | 0.61% | 0.45% |
| $C_7$ Asphaltene Conversion, % | 40.6% | 43.0% | 46.9% | 46.9% |
| MCR Conversion, % | 49.3% | 51.9% | 55.2% | 54.8% |

Examples 1 and 2 utilized a heterogeneous catalyst to simulate an ebullated bed reactor prior to being upgraded to employ a dual catalyst system according to the invention. Examples 3 and 4 utilized a dual catalyst system comprised of the same heterogeneous catalyst of Examples 1 and 2 and also dispersed molybdenum sulfide catalyst particles. The concentration of dispersed molybdenum sulfide catalyst particles in the feedstock was measured as concentration in parts per million (ppm) of molybdenum metal (Mo) provided by the dispersed catalyst. The feedstock of Examples 1 and 2 included no dispersed catalyst (0 ppm Mo), the feedstock of Example 3 included dispersed catalyst at a concentration of 30 ppm Mo, and the feedstock of Example 4 included dispersed catalyst at a higher concentration of 50 ppm Mo.

Example 1 was the baseline test in which Ural VR was hydroprocessed at a temperature of 789° F. (421° C.) and a resid conversion of 60.0%. In Example 2, the temperature was increased to 801° F. (427° C.) and resid conversion (based on 1000° F.+, %) was increased to 67.7%. This resulted in a substantial increase in product IP-375 sediment (separator bottoms basis, wt. %) of 0.78% to 1.22%, product IP-375 sediment (feed oil basis, wt. %) of 0.67% to 0.98%, a $C_7$ asphaltene conversion of 40.6% to 43.0%, and MCR conversion of 49.3% to 51.9%. This indicates that the heterogeneous catalyst used by itself in Examples 1 and 2 could not withstand an increase in temperature and conversion without a substantial increase in sediment formation.

In Example 3, which utilized the dual catalyst system, including dispersed catalyst (providing 30 ppm Mo), reactor temperature was increased to 801° F. (427° C.) and resid conversion was increased to 67.0%. Feed rate was increased slightly from 0.24 to 0.25 (LHSV, vol. feed/vol. reactor/hour). Even at higher temperature, resid conversion, and feed rate, there was a slight decrease in product IP-375 sediment (separator bottoms basis, wt. %) of 0.78% to 0.76%, a more substantial decrease in product IP-375 sediment (feed oil basis, wt. %) of 0.67% to 0.61%. In addition to increased resid conversion, the $C_7$ asphaltene conversion was increased from 40.6% to 46.9%, and MCR conversion was increased from 49.3% to 55.2%.

The dual catalyst system of Example 3 also substantially outperformed the heterogeneous catalyst used by itself in Example 2 by a wide margin, including further increasing $C_7$ asphaltene conversion from 43.0% to 46.9% and MCR conversion from 51.9% to 55.2%, while substantially decreasing product IP-375 sediment (separator bottoms basis, wt. %) from 1.22% to 0.76%, and product IP-375 sediment (feed oil basis, wt. %) from 0.98% to 0.61%.

In Example 4, which utilized the dual catalyst system, including dispersed catalyst (providing 50 ppm Mo), reactor temperature was 801° F. (427° C.), conversion was 65.9%, and feed rate was 0.25 (LHSV, vol. feed/vol. reactor/hour). Compared to Example 1, there was a substantial decrease in product IP-375 sediment (separator bottoms basis, wt. %) of 0.78% to 0.54%, a substantial decrease in product IP-375 sediment (feed oil basis, wt. %) of 0.67% to 0.45%. In addition, the $C_7$ asphaltene conversion was increased from 40.6% to 46.9%, and MCR conversion was increased from 49.3% to 54.8%. This indicates that the dual catalyst system of Example 4 also substantially outperformed the heterogeneous catalyst used by itself in Example 2 by an even wider margin, including further increasing $C_7$ asphaltene conversion from 43.0 to 46.9% and MCR conversion from 51.9% to 54.8%, while decreasing product IP-375 sediment (separator bottoms basis, wt. %) from 1.22% to 0.54%, and product IP-375 sediment (feed oil basis, wt. %) from 0.98% to 0.45%.

Examples 3 and 4 clearly demonstrated the ability of a dual catalyst system in an upgraded ebullated hydroprocessing reactor to permit increased reactor severity, including increased operating temperature, resid conversion, $C_7$ asphaltene conversion, and MCR conversion, and equal feed rate (throughput) while substantially reducing sediment production, compared to an ebullated bed reactor using only a heterogeneous catalyst.

Examples 5-8

Examples 5-8 were conducted in the aforementioned pilot plant and also tested the ability of an upgraded ebullated bed reactor that employed a dual catalyst system to operate at substantially higher conversion at equal feed rate (throughput) while maintaining or reducing formation of sediment. The increased conversion included higher resid conversion, $C_7$ asphaltene conversion, and micro carbon residue (MCR) conversion. The heavy oil feedstock utilized in this study was Arab Medium vacuum resid (VR). Relevant process conditions and results are set forth in Table 2.

TABLE 2

| Example # | 5 | 6 | 7 | 8 |
|---|---|---|---|---|
| Feedstock | Arab Medium VR | Arab Medium VR | Arab Medium VR | Arab Medium VR |
| Dispersed Catalyst Conc. | 0 | 0 | 30 | 50 |
| Reactor Temperature (° F.) | 803 | 815 | 815 | 815 |
| LHSV, vol. feed/vol. reactor/hr | 0.25 | 0.25 | 0.25 | 0.25 |
| Resid Conversion, based on 1000° F.+, % | 73.2% | 81.4% | 79.9% | 80.8% |
| Product IP-375 Sediment, Separator Bottoms Basis, wt % | 1.40% | 0.91% | 0.68% | 0.43% |
| Product IP-375 Sediment, Feed Oil Basis, wt % | 1.05% | 0.61% | 0.49% | 0.31% |

TABLE 2-continued

| Example # | 5 | 6 | 7 | 8 |
|---|---|---|---|---|
| $C_7$ Asphaltene Conversion, % | 55.8% | 65.9% | 72.9% | 76.0% |
| MCR Conversion, % | 47.2% | 55.2% | 57.7% | 61.8% |

It is noted that the sediment data for Examples 5 and 6 may conceptually have the wrong directional trend for sediment production (i.e., lower sediment at higher resid conversion while using the same heterogeneous catalyst and no dispersed catalyst). Nevertheless, the results comparing Examples 6-8 demonstrated a clear improvement when using the dual catalyst system.

Examples 5 and 6 utilized a heterogeneous catalyst to simulate an ebullated bed reactor prior to being upgraded to employ a dual catalyst system according to the invention. Examples 7 and 8 utilized a dual catalyst system comprised of the same heterogeneous catalyst of Examples 5 and 6 and dispersed molybdenum sulfide catalyst particles. The concentration of dispersed molybdenum sulfide catalyst particles in the feedstock was measured as concentration in parts per million (ppm) of molybdenum metal (Mo) provided by the dispersed catalyst. The feedstock of Examples 5 and 6 included no dispersed catalyst (0 ppm Mo); the feedstock of Example 7 included dispersed catalyst (30 ppm Mo), and the feedstock of Example 8 included dispersed catalyst (50 ppm Mo).

Example 5 was the baseline test in which Arab Medium VR was hydroprocessed at a temperature of 803° F. (428° C.) and a resid conversion of 73.2%. In Example 6, the temperature was increased to 815° F. (435° C.) and resid conversion (based on 1000° F.+, %) was increased to 81.4%. The product IP-375 sediment (separator bottoms basis, wt. %) decreased from 1.40% to 0.91%, product IP-375 sediment (feed oil basis, wt. %) decreased from 1.05% to 0.61%, $C_7$ asphaltene conversion increased from 55.8% to 65.9%, and MCR conversion increased from 47.2% to 55.2%. For purposes of comparing the effect of the dual catalyst system of Examples 7 and 8, either Example 5 and 6 can be used. However, the most direct comparison is to the results in Example 6, which was conducted at a resid conversion essentially the same as for Examples 7 and 8.

In Example 7, which utilized dispersed catalyst particles (providing 30 ppm Mo), reactor temperature was increased from to 803° F. (428° C.) in Example 5 to 815° F. (435° C.) and resid conversion was increased to from 73.2% in Example 5 to 79.9%. Feed rate was maintained at 0.25 (LHSV, vol. feed/vol. reactor/hour). Even at higher temperature, conversion and feed rate, there was a decrease in product IP-375 sediment (separator bottoms basis, wt. %) from 1.40% to 0.68%, a decrease in product IP-375 sediment (feed oil basis, wt. %) of 1.05% to 0.49%. In addition to increased resid conversion, the C7 asphaltene conversion was increased from 55.8% to 72.9%, and MCR conversion was increased from 47.2% to 57.7%.

The dual catalyst system of Example 7 also substantially outperformed the heterogeneous catalyst used by itself in Example 6 by a wide margin, including further increasing $C_7$ asphaltene conversion from 65.9% to 72.9% and MCR conversion from 55.2% to 57.7%, while substantially decreasing product IP-375 sediment (separator bottoms basis, wt. %) from 0.91% to 0.68%, and product IP-375 sediment (feed oil basis, wt. %) from 0.61% to 0.49%.

In Example 8, which utilized dispersed catalyst particles (providing 50 ppm Mo), reactor temperature was 815° F. (435° C.), conversion was 80.8%, and feed rate was 0.25 (LHSV, vol. feed/vol. reactor/hour). Compared to Example 5, there was a substantial decrease in product IP-375 sediment (separator bottoms basis, wt. %) from 1.40% to 0.43%, a substantial decrease in product IP-375 sediment (feed oil basis, wt. %) of 1.05% to 0.31%. In addition, the $C_7$ asphaltene conversion was increased from 55.8% to 76.0%, and MCR conversion was increased from 47.2% to 61.8%.

The dual catalyst system of Example 8 also substantially outperformed the heterogeneous catalyst used by itself in Example 6, including further increasing $C_7$ asphaltene conversion from 65.9 to 76.0% and MCR conversion from 55.2% to 61.8%, while decreasing product IP-375 sediment (separator bottoms basis, wt. %) from 0.91% to 0.43%, and product IP-375 sediment (feed oil basis, wt. %) from 0.61% to 0.31%.

Examples 7 and 8 clearly demonstrated the ability of a dual catalyst system in an upgraded ebullated bed hydroprocessing reactor to permit increased reactor severity, including increased operating temperature, resid conversion, $C_7$ asphaltene conversion, and MCR conversion, and equal feed rate (throughput) while substantially reducing sediment production, compared to an ebullated bed reactor using only a heterogeneous catalyst.

Examples 9-13

Examples 9-13 are commercial results showing the ability of an upgraded ebullated bed reactor that employed a dual catalyst system to permit substantially higher conversion at equal feed rate (throughput) while maintaining or reducing formation of sediment. The increased conversion included higher resid conversion, $C_7$ asphaltene conversion, and micro carbon residue (MCR) conversion. The heavy oil feedstock utilized in this study was Ural vacuum resid (VR). The data in this study only shows relative rather than absolute results to maintain customer confidentiality. Relevant process conditions and results are set forth in Table 1.

TABLE 3

| Example # | 9 | 10 | 11 | 12 | 13 |
|---|---|---|---|---|---|
| Condition | Baseline (no disp. cat.) | dispersed catalyst +0° C. | dispersed catalyst +4° C. | dispersed catalyst +6° C. | dispersed catalyst +9° C. |
| Test Days | 7 to 21 | 35 to 42 | 48 to 54 | 56 to 62 | 65 to 75 |
| Feedstock | Ural VR | Ural VR | Ural VR | Ural VR | Ural VR |
| Dispersed Catalyst Conc. | 0 | 32 | 32 | 32 | 32 |

TABLE 3-continued

| Example # | 9 | 10 | 11 | 12 | 13 |
|---|---|---|---|---|---|
| Reactor Temperature (° F.) LHSV, vol. feed/vol. reactor/hr | $T_{base}$ $LHSV_{base}$ | $T_{base}$ $LHSV_{base}$ | $T_{base}$ +4° C. $LHSV_{base}$ | $T_{base}$ +6° C. $LHSV_{base}$ | $T_{base}$ +9° C. $LHSV_{base}$ |
| Resid Conversion, based on 1000° F.+, % (absolute difference from baseline) | $Conv_{base}$ | $Conv_{base}$ −1.3% | $Conv_{base}$ +2.7% | $Conv_{base}$ +6.3% | $Conv_{base}$ +10.4% |
| Product IP-375 Sediment, Separator Bottoms Basis, wt % (absolute difference from baseline) | $Sed_{base}$ | $Sed_{base}$ −0.12 wt % | $Sed_{base}$ −0.09 wt % | $Sed_{base}$ −0.06 wt % | $Sed_{base}$ −0.07 wt % |
| Product IP-375 Sediment, Feed Oil Basis, wt % (absolute difference from baseline) | $Sed_{base}$ | $Sed_{base}$ −0.02 wt % | $Sed_{base}$ −0.05 wt % | $Sed_{base}$ −0.05 wt % | $Sed_{base}$ −0.07 wt % |
| $C_7$ Asphaltene Conversion, % (absolute difference from baseline) | $C_{7\ base}$ | $C_{7\ base}$ +18% | $C_{7\ base}$ +25% | $C_{7\ base}$ +25% | $C_{7\ base}$ +18% |
| MCR Conversion, % (absolute difference from baseline) | $MCR_{base}$ | $MCR_{base}$ | $MCR_{base}$ +2% | $MCR_{base}$ +3% | $MCR_{base}$ +4% |

Example 9 utilized a heterogeneous catalyst in an ebullated bed reactor prior to being upgraded to employ a dual catalyst system according to the invention. Examples 10-13 utilized a dual catalyst system comprised of the same heterogeneous catalyst of Example 9 and dispersed molybdenum sulfide catalyst particles. The concentration of dispersed molybdenum sulfide catalyst particles in the feedstock was measured as concentration in parts per million (ppm) of molybdenum metal (Mo) provided by the dispersed catalyst. The feedstock of Example 9 included no dispersed catalyst (0 ppm Mo); the feedstocks of Examples 10-13 included dispersed catalyst (32 ppm Mo).

Example 9 was the baseline test in which Ural VR was hydroprocessed at a base temperature ($T_{base}$), base feed rate ($LHSV_{base}$), a base resid conversion ($Conv_{base}$), base sediment formation ($Sed_{base}$), base $C_7$ conversion ($C_{7\ base}$), and base MCR conversion ($MCR_{base}$).

In Example 10, the temperature ($T_{base}$) and feed rate ($LHSV_{base}$) were the same as in Example 9. Including dispersed catalyst resulted in a slight decrease in resid conversion of 1.3% compared to the base resid conversion ($Conv_{base}$−1.3%), a decrease in product IP-375 sediment (separator bottoms basis, wt. %) of 0.12% ($Sed_{base}$−0.12%), a decrease in product IP-375 sediment (feed oil basis, wt. %) of 0.02% ($Sed_{base}$−0.02%), an increase in $C_7$ asphaltene conversion of 18% ($C_{7\ base}$+18%), and no change in MCR conversion ($MCR_{base}$). This indicates that by simply upgrading the ebullated bed reactor to include the dual catalyst system (Example 10) instead of the heterogeneous catalyst used by itself (Example 9), $C_7$ asphaltene conversion was increased substantially while sediment formation decreased. Even though resid conversion decreased slightly, the far more important statistic is the increase in $C_7$ asphaltene conversion since that is the component most responsible for coke formation and equipment fouling.

In Example 11, the temperature ($T_{base}$) was increased by 4° C. ($T_{base}$+4° C.) compared to Example 9 and the feed rate ($LHSV_{base}$) was the same. This resulted in increased resid conversion of 2.7% ($Conv_{base}$+2.7%), a decrease in product IP-375 sediment (separator bottoms basis, wt. %) of 0.09% ($Sed_{base}$−0.09%), a decrease in product IP-375 sediment (feed oil basis, wt. %) of 0.05% ($Sed_{base}$−0.05%), an increase in $C_7$ asphaltene conversion of 25% ($C_{7\ base}$+25%), and an increase in MCR conversion of 2% ($MCR_{base}$+2%). This indicates that upgrading the ebullated bed reactor to include the dual catalyst system instead of the heterogeneous catalyst used by itself increased resid conversion, substantially increased $C_7$ asphaltene conversion, increased MCR conversion, while decreasing sediment formation. While resid conversion increased slightly, the far more important statistic is the substantially higher increase in $C_7$ asphaltene conversion.

In Example 12, the temperature ($T_{base}$) was increased by 6° C. ($T_{base}$+6° C.) compared to Example 9 and the feed rate ($LHSV_{base}$) was the same. This resulted in a substantially higher resid conversion of 6.3% ($Conv_{base}$+6.3%), a decrease in product IP-375 sediment (separator bottoms basis, wt. %) of 0.06% ($Sed_{base}$−0.06%), a decrease in product IP-375 sediment (feed oil basis, wt. %) of 0.05% ($Sed_{base}$−0.05%), an increase in $C_7$ asphaltene conversion of 25% ($C_{7\ base}$+25%), and an increase in MCR conversion of 3% ($MCR_{base}$+3%). This indicates that upgrading the ebullated bed reactor to include the dual catalyst system instead of the heterogeneous catalyst used by itself substantially increased resid conversion, $C_7$ asphaltene conversion, increased MCR conversion, while decreasing sediment formation.

In Example 13, the temperature ($T_{base}$) was increased by 9° C. ($T_{base}$+9° C.) compared to Example 9 and the feed rate ($LHSV_{base}$) was the same. This resulted in a substantially higher resid conversion of 10.4% ($Conv_{base}$+10.4%), a decrease in product IP-375 sediment (separator bottoms basis, wt. %) of 0.07% ($Sed_{base}$−0.07%), a decrease in product IP-375 sediment (feed oil basis, wt. %) of 0.07% ($Sed_{base}$−0.07%), an increase in $C_7$ asphaltene conversion of 18% ($C_{7\ base}$+18%), and an increase in MCR conversion of 4% ($MCR_{base}$+4%). This indicates that upgrading the ebullated bed reactor to include the dual catalyst system instead of the heterogeneous catalyst used by itself substantially increased resid conversion, $C_7$ asphaltene conversion, and MCR conversion, while decreasing sediment formation.

Examples 10-13 clearly demonstrated the ability of a dual catalyst system in an upgraded ebullated hydroprocessing reactor to permit increased reactor severity, including increased operating temperature, resid conversion, $C_7$ asphaltene conversion, and MCR conversion, and equal feed rate (throughput) while substantially reducing sediment production, compared to an ebullated bed reactor using only a heterogeneous catalyst.

Figure 6:
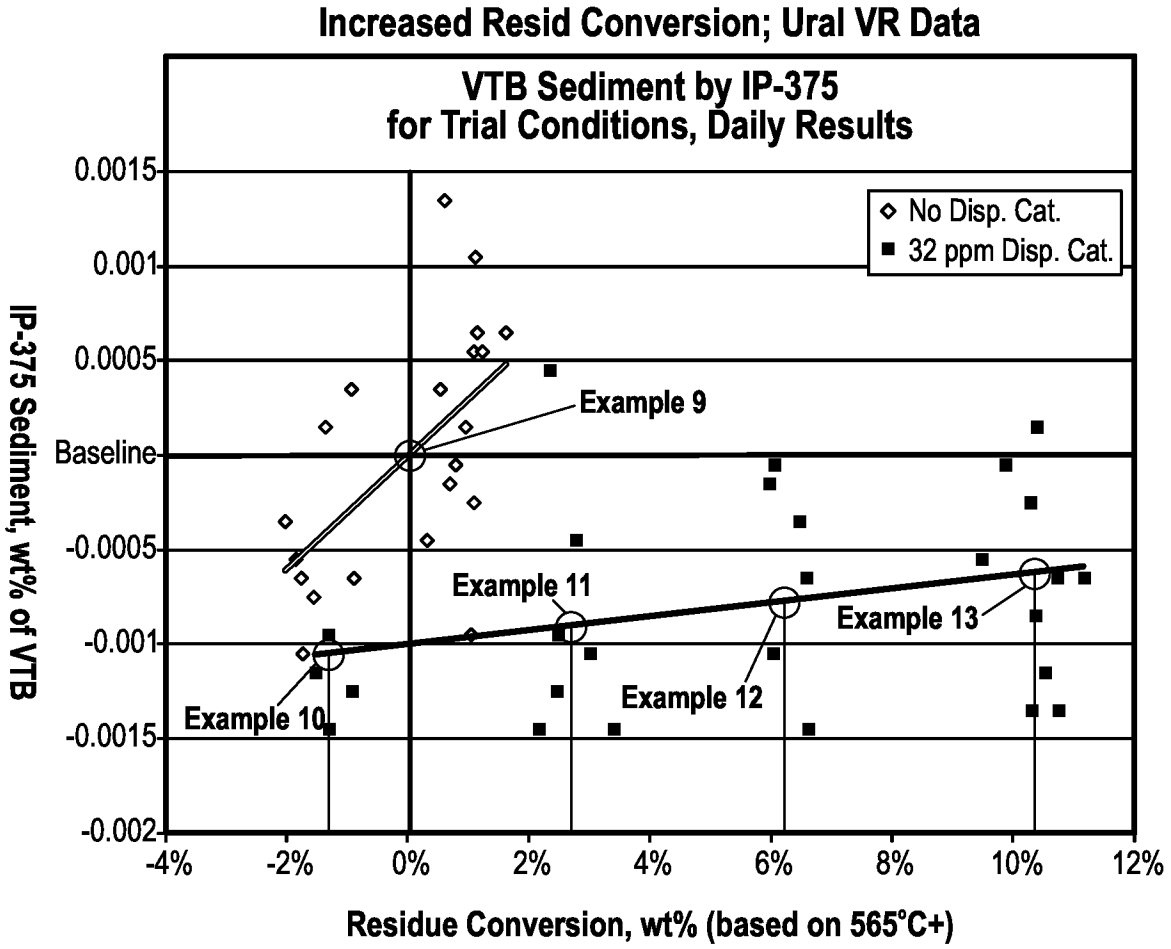
FIG. 6 is a scatter plot and line graph graphically representing relative IP-375 Sediment in vacuum tower bottoms (VTB) as a function of Residue Conversion compared to baseline levels when hydroprocessing Ural vacuum residuum (VR) using different dispersed metal sulfide concentrations according to Examples 9-13.
Figure 9:
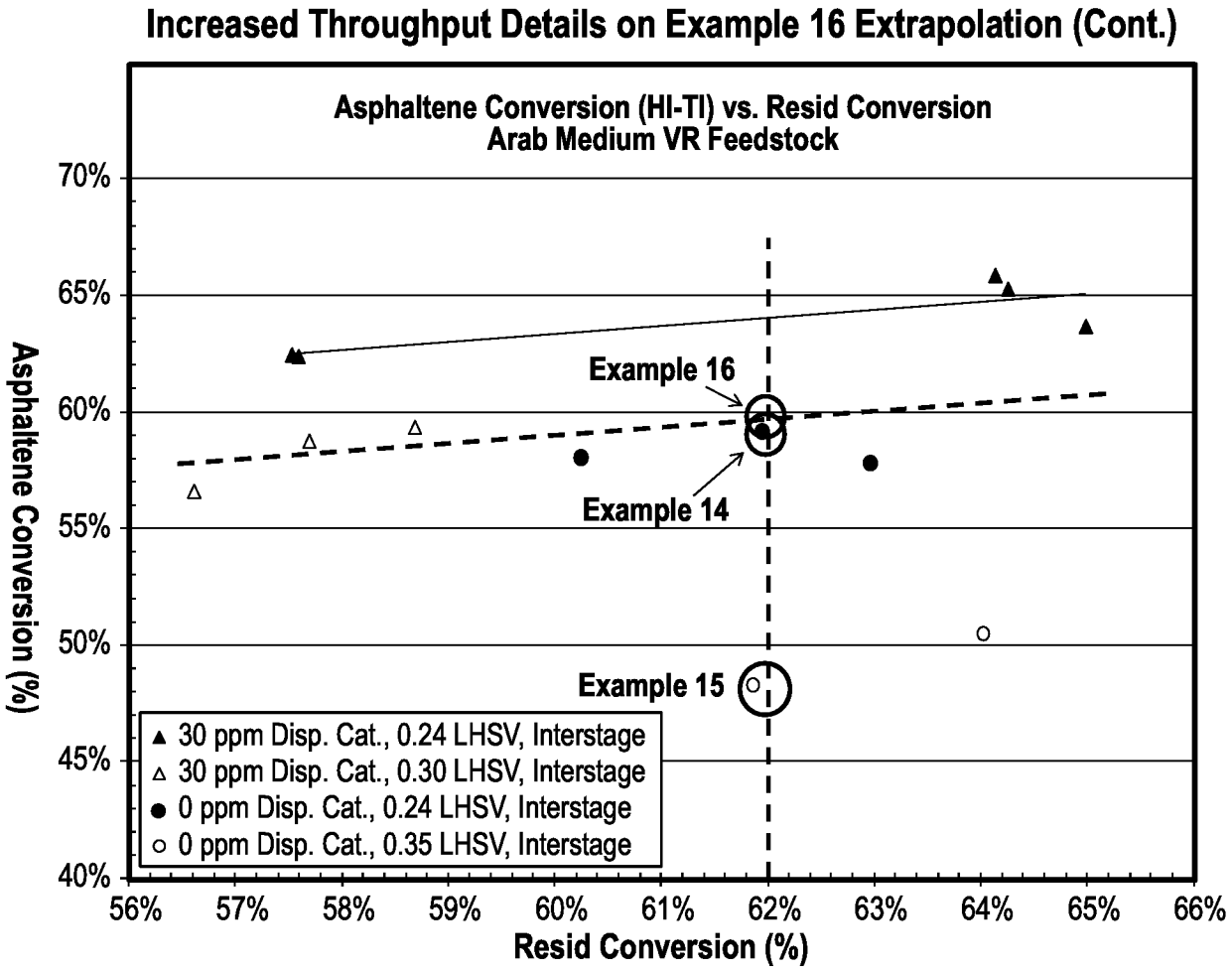
FIG. 9 is a scatter plot and line graph graphically representing Asphaltene Conversion as a function of Resid Conversion when hydroprocessing Arab Medium vacuum residuum (VR) using different dispersed metal sulfide concentrations according to Examples 14-16.

In addition to the data shown in Table 3, FIG. 6 is a scatter plot and line graph graphically representing IP-375 sediment in vacuum tower bottoms (VTB) as a function of residue conversion compared to baseline levels when hydroprocessing vacuum residuum (VR) using different catalysts according to Examples 9-13. FIG. 9 provides a visual comparison between the amount of sediment in vacuum tower bottoms (VTB) produced using a conventional ebullated bed reactor compared to an upgraded ebullated bed reactor utilizing a dual catalyst system.

Examples 14-16

Examples 14-16 were conducted in the aforementioned pilot plant and tested the ability of an upgraded ebullated bed reactor that employed a dual catalyst system to operate at substantially higher feed rate (throughput) at equal resid conversion while maintaining or reducing formation of sediment. The heavy oil feedstock utilized in this study was Arab medium vacuum resid (VR). Relevant process conditions and results are set forth in Table 4.

TABLE 4

| Example # | 14 | 15 | 16* |
|---|---|---|---|
| Feedstock | Arab Medium VR | Arab Medium VR | Arab Medium VR |
| Dispersed Catalyst Conc. | 0 | 0 | 30 |
| Reactor Temperature (° F.) | 788 | 800 | 803 |
| LHSV, vol. feed/vol. reactor/hr | 0.24 | 0.33 | 0.3 |
| Resid Conversion, based on 1000° F.+, % | 62% | 62% | 62% |
| Product IP-375 Sediment, Separator Bottoms Basis, wt % | 0.37% | 0.57% | 0.10% |
| Product IP-375 Sediment, Feed Oil Basis, wt % | 0.30% | 0.44% | 0.08% |
| $C_7$ Asphaltene Conversion, % | 58.0% | 48.0% | 59.5% |
| MCR Conversion, % | 58.5% | 53.5% | 57.0% |

*Note:
The conditions in Example 16 were 15 extrapolated from the conditions of Example 15 based on performance of other test conditions during the same pilot plant run.

Examples 14 and 15 utilized a heterogeneous catalyst to simulate an ebullated bed reactor prior to being upgraded to employ a dual catalyst system according to the invention. Example 16 utilized a dual catalyst system comprised of the same heterogeneous catalyst of Examples 14 and 15 and dispersed molybdenum sulfide catalyst particles. The concentration of dispersed molybdenum sulfide catalyst particles in the feedstock was measured as concentration in parts per million (ppm) of molybdenum metal (Mo) provided by the dispersed catalyst. The feedstock of Examples 14 and 15 included no dispersed catalyst (0 ppm Mo); the feedstock of Example 16 included dispersed catalyst (30 ppm Mo).

Example 14 was the baseline test in which Arab Medium VR was hydroprocessed at a temperature of 788° F. (420° C.) and a resid conversion of 62%. In Example 15, the temperature was increased to 800° F. (427° C.), resid conversion was maintained at 62%, and feed rate (LHSV, vol. feed/vol. reactor/hour) was increased to 0.33. This resulted in a substantial increase in product IP-375 sediment (separator bottoms basis, wt. %) from 0.37% to 0.57%, increased product IP-375 sediment (feed oil basis, wt. %) from 0.30% to 0.44%, a $C_7$ substantial decrease in asphaltene conversion of 58.0% to 48.0%, and a decrease in MCR conversion from 58.5% to 53.5%. This indicates that the heterogeneous catalyst used by itself in Examples 14 and 15 could not withstand an increase in temperature and feed rate without a substantial increase in sediment formation.

In Example 16, which utilized dispersed catalyst particles (providing 30 ppm Mo), reactor temperature was increased to 803° F. (428° C.), resid conversion was maintained at 62%, and feed rate was increased from 0.24 to 0.3 (LHSV, vol. feed/vol. reactor/hour). Even at higher temperature and feed rate, while maintaining the same resid conversion, there was a substantial decrease in product IP-375 sediment (separator bottoms basis, wt. %) from 0.37% to 0.10%, a substantial decrease in product IP-375 sediment (feed oil basis, wt. %) from 0.30% to 0.08%. In addition, the $C_7$ asphaltene conversion increased from 58.0% to 59.5% and the MCR conversion decreased from 58.5% to 57.0%.

The dual catalyst system of Example 16 also substantially outperformed the heterogeneous catalyst in Example 15 by a wide margin, including substantially decreasing product IP-375 sediment (separator bottoms basis, wt. %) from 0.57% to 0.10%, substantially decreasing product IP-375 sediment (feed oil basis, wt. %) from 0.44% to 0.08%, substantially increasing $C_7$ asphaltene conversion from 48.0% to 59.5%, and increasing MCR conversion from 53.5% to 57.0%.

Figure 7:
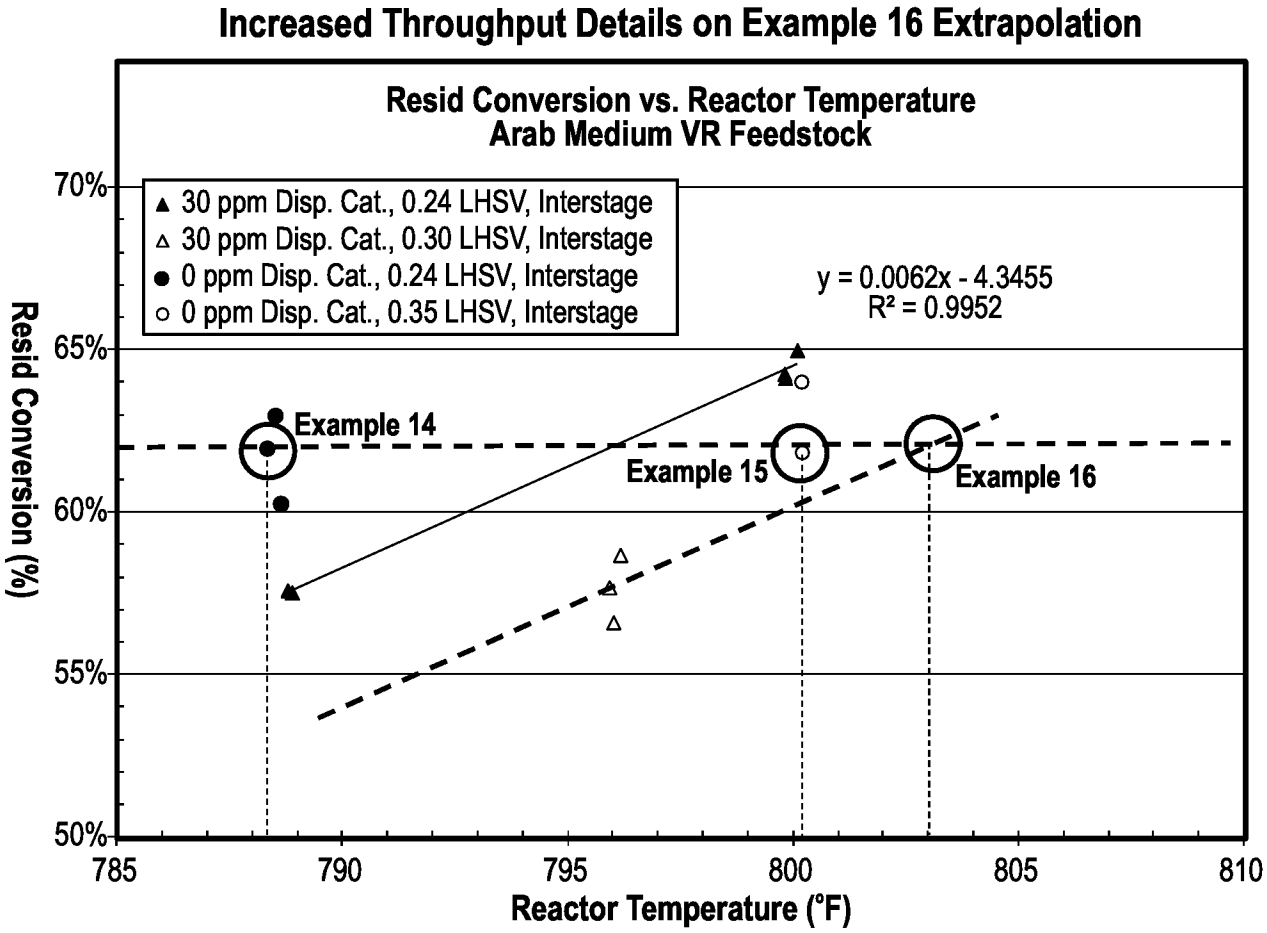
FIG. 7 is a scatter plot and line graph graphically representing Resid Conversion as a function of Reactor Temperature when hydroprocessing Arab Medium vacuum residuum (VR) using different dispersed metal sulfide concentrations according to Examples 14-16.

In addition to the data shown in Table 3, FIG. 7 is a scatter plot and line graph graphically representing Resid Conversion as a function of Reactor Temperature when hydroprocessing Arab Medium vacuum residuum (VR) using different dispersed catalyst concentrations and operating conditions according to Examples 14-16.

Figure 8:
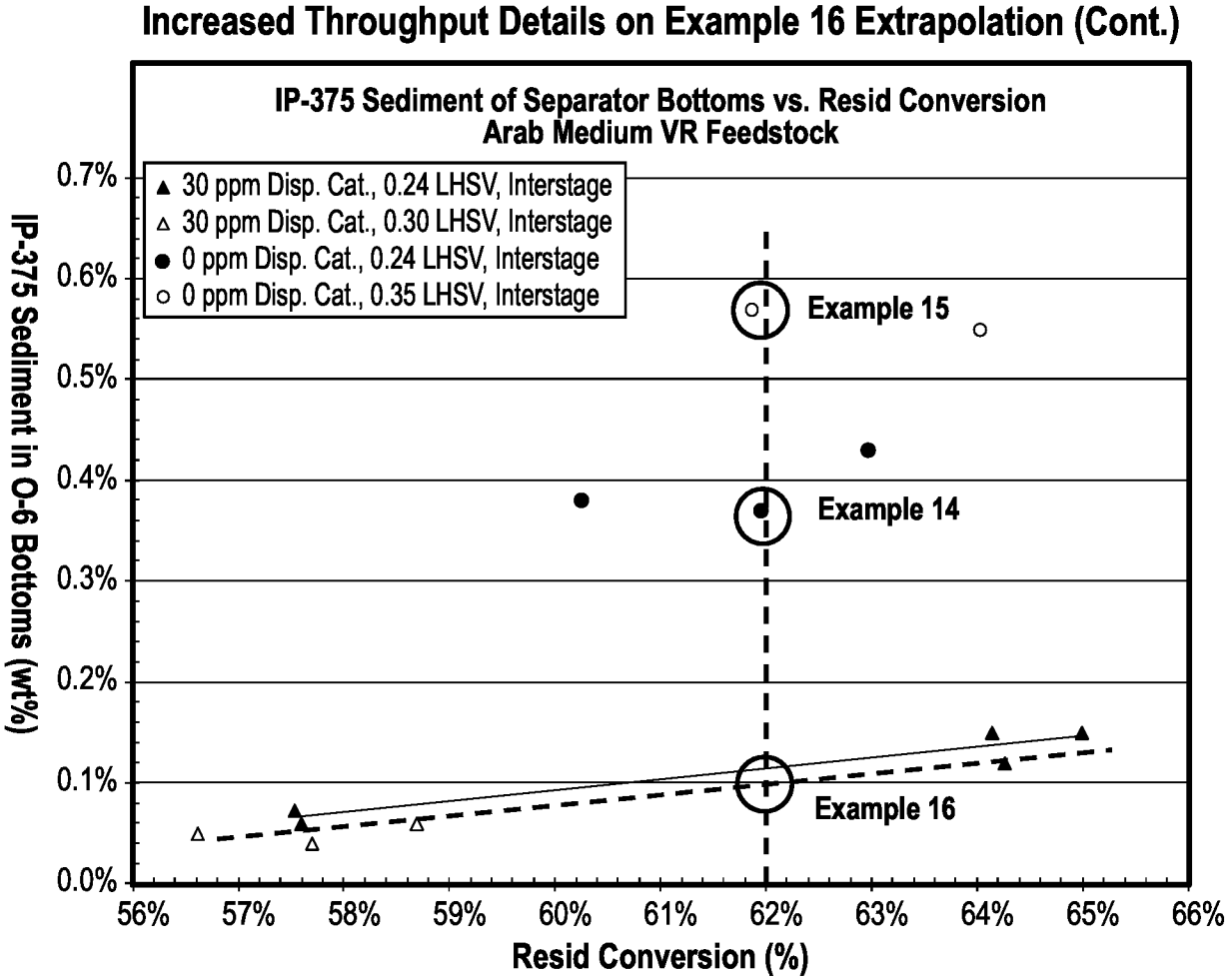
FIG. 8 is a scatter plot and line graph graphically representing IP-375 Sediment in O-6 Bottoms as a function of Resid Conversion when hydroprocessing Arab Medium vacuum residuum (VR) using different catalysts according to Examples 14-16.

FIG. 8 is a scatter plot and line graph graphically representing IP-375 Sediment in O-6 Bottoms as a function of Resid Conversion when hydroprocessing Arab Medium VR using different catalysts according to Examples 14-16.

FIG. 9 is a scatter plot and line graph graphically representing Asphaltene Conversion as a function of Resid Conversion when hydroprocessing Arab medium VR using different dispersed catalyst concentrations and operating conditions according to Examples 14-16.

Figure 10:
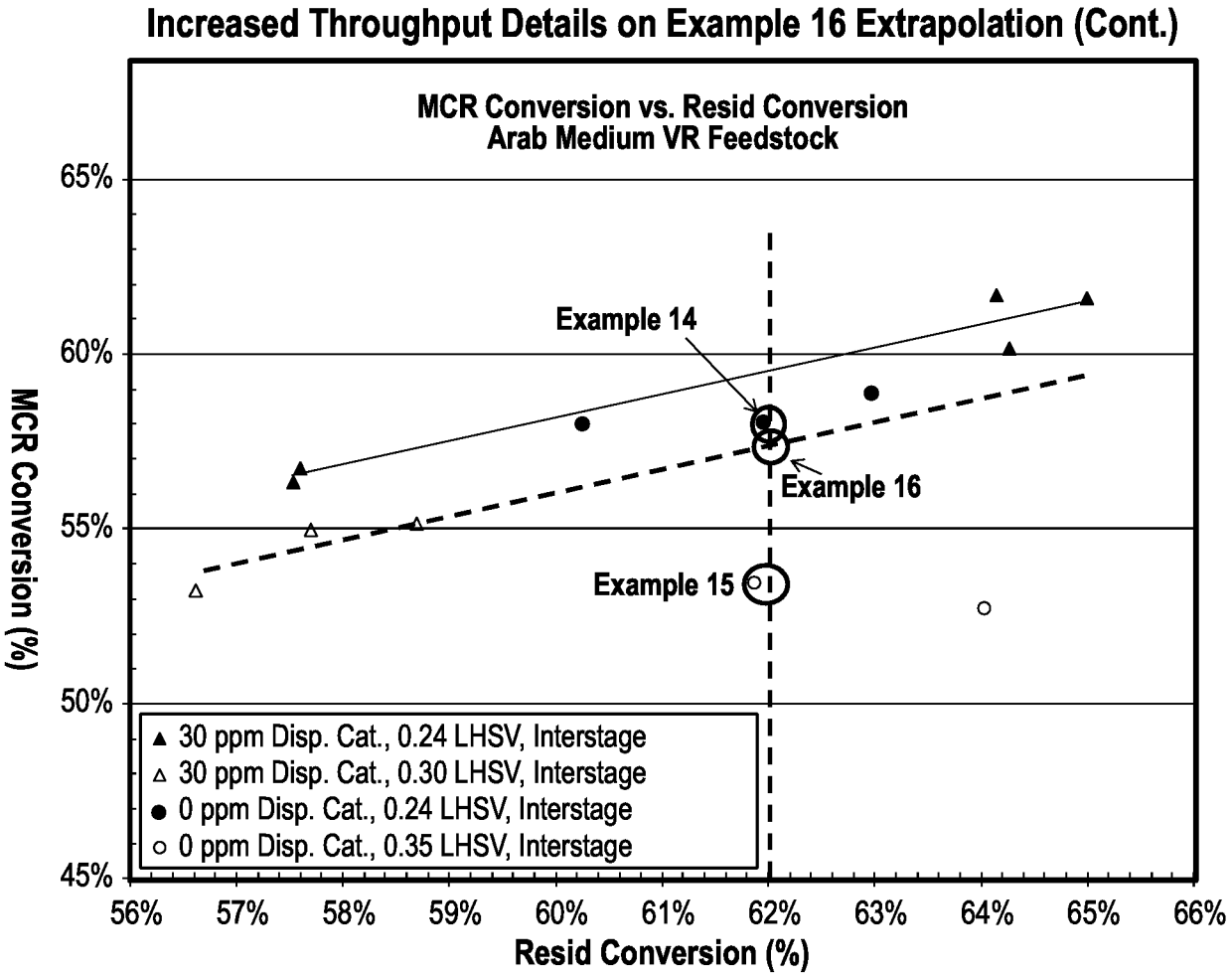
FIG. 10 is a scatter plot and line graph graphically representing micro carbon residue (MCR) Conversion as a function of Resid Conversion when hydroprocessing Arab Medium vacuum residuum (VR) using different dispersed metal sulfide concentrations according to Examples 14-16.

FIG. 10 is a scatter plot and line graph graphically representing micro carbon residue (MCR) Conversion as a function of Resid Conversion when hydroprocessing Arab medium VR using different dispersed catalyst concentrations and operating conditions according to Examples 14-16.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method of upgrading an ebullated bed hydroprocessing system that includes one or more ebullated bed reactors to increase rate of production of converted products from heavy oil, comprising:

operating an ebullated bed reactor using a heterogeneous catalyst to hydroprocess heavy oil at initial conditions, including an initial reactor severity and initial rate of production of converted products, wherein the initial reactor severity includes operating the ebullated bed reactor at an initial temperature in a range of about 750° F. (399° C.) to about 860° F. (460° C.) initial throughput of heavy oil, initial conversion of heavy oil, and initial rate of equipment fouling;

thereafter upgrading the ebullated bed reactor to operate using a dual catalyst system comprised of dispersed metal sulfide catalyst particles and heterogeneous catalyst; and operating the upgraded ebullated bed reactor using the dual catalyst system to hydroprocess heavy oil at higher reactor severity relative to the initial reactor severity to increase the rate of production of converted products relative to the initial rate of production of converted products while maintaining a rate of equipment fouling that is equal to or less than the initial rate of equipment fouling when operating the ebullated bed reactor at the initial reactor severity, wherein operating the upgraded ebullated bed reactor to hydroprocess heavy oil at higher reactor severity relative to the initial reactor severity includes at least one of:

(i) increasing the operating temperature of the ebullated bed reactor by at least 2.5° C. relative to the initial operating temperature, increasing the throughput of heavy oil by at least 5% relative to the initial throughput, and maintaining or increasing the conversion of heavy oil relative to the initial conversion; or (ii) increasing the operating temperature of the ebullated bed reactor by at least 5° C. relative to the initial operating temperature, increasing the conversion of heavy oil by at least 5% relative to the initial conversion, and maintaining or increasing the throughput of heavy oil relative to the initial throughput.

2. The method of claim 1, wherein the heavy oil comprises at least one of heavy crude oil, oil sands bitumen, residuum from refinery processes, atmospheric tower bottoms having a nominal boiling point of at least 343° C. (650° F.), vacuum tower bottoms having a nominal boiling point of at least 524° C. (975° F.), resid from a hot separator, resid pitch, resid from solvent extraction, or vacuum residue.

3. The method of claim 1, wherein operating the upgraded ebullated bed reactor at higher reactor severity relative to the initial reactor severity includes increasing the throughput of heavy oil by at least 5% relative to the initial throughput, increasing the operating temperature of the ebullated bed reactor by at least 2.5° C. relative to the initial temperature, and maintaining or increasing the conversion of heavy oil.

4. The method of claim 3, the increased throughput of heavy oil being at least 10% higher, at least 15% higher, or at least 20% higher, than the initial throughput and the increased temperature being at least 5° C. higher, or at least 7.5° C. higher, or at least 10° C. higher, than the initial temperature.

5. The method of claim 1, wherein operating the upgraded ebullated bed reactor at higher reactor severity relative to the initial reactor severity includes increasing conversion of heavy oil by at least 5% relative to the initial percent conversion, increasing the operating temperature of the ebullated bed reactor by at least 5° C. relative to the initial temperature, and maintaining or increasing the throughput of heavy oil.

6. The method of claim 5, the increased conversion of heavy oil being at least 7.5% higher than the initial conversion, and the increased temperature being at least 7.5° C. higher than the initial temperature.

7. The method of claim 6, the increased conversion of heavy oil being at least 10% higher, or at least 15% higher, than the initial conversion, and the increased temperature being at least 10° C. higher, or at least 15° C. higher, than the initial temperature.

8. The method of claim 1, wherein operating the upgraded ebullated bed reactor at higher reactor severity than the initial reactor severity includes increasing conversion of heavy oil by at least 2.5% relative to the initial percent conversion, increasing throughput of heavy oil by at least 5% relative to the initial conversion, and increasing operating temperature of the ebullated bed reactor by at least 5° C. relative to the initial temperature.

9. The method of claim 8, the increased conversion of heavy oil being at least 5% higher than the initial conversion, and the increased temperature being at least 7.5° C. higher than the initial temperature.

10. The method of claim 1, wherein operating the upgraded ebullated bed reactor using the dual catalyst system at higher reactor severity and increased rate of production of converted products results in a rate of equipment fouling that is less than when operating the ebullated bed reactor at the initial conditions.

11. The method of claim 1, wherein the rate of equipment fouling when operating the upgraded ebullated bed reactor using the dual catalyst system results in at least one of:

frequency of heat exchanger shutdowns for cleanout that is equal to or less than when operating the ebullated bed reactor at the initial conditions;

frequency of atmospheric and/or vacuum distillation tower shutdowns for cleanout that is equal or less than when operating the ebullated bed reactor at the initial conditions;

frequency of changes or cleanings of filters and strainers that is equal or lower than when operating the ebullated bed reactor at the initial conditions;

frequency of switches to spare heat exchangers that is equal or lower than when operating the ebullated bed reactor at the initial conditions;

reduced rate of decreasing skin temperatures in equipment selected from one or more of heat exchangers, separators, or distillation towers than when operating the ebullated bed reactor at the initial conditions;

reduced rate of increasing furnace tube metal temperatures than when operating the ebullated bed reactor at the initial conditions; or reduced rate of increasing calculated resistance fouling factors for heat exchangers than when operating the ebullated bed reactor at the initial conditions.

12. The method of claim 1, wherein operating the upgraded ebullated bed reactor using the dual catalyst system at higher reactor severity and increased rate of production of converted products results in a rate of sediment production that is equal to or less than when operating the ebullated bed reactor at the initial conditions.

13. The method of claim 12, the rate of sediment production being based on at least one of:

a measurement of sediment in atmospheric tower bottoms product;

a measurement of sediment in a vacuum tower bottoms product;

a measurement of sediment in product from a hot low pressure separator; or a measurement of sediment in fuel oil product before or after addition of cutter stocks.

14. The method of claim 1, wherein operating the upgraded ebullated bed reactor using the dual catalyst system at higher reactor severity and increased rate of production of converted products results in a product sediment concentration that is equal to or less than when operating the ebullated bed reactor at the initial conditions.

15. The method of claim 14, the product sediment concentration being based on at least one of:

measurement of sediment in an atmospheric tower bottoms product;

measurement of sediment in a vacuum tower bottoms product;

measurement of sediment in product from a hot low pressure separator;

measurement of sediment in fuel oil product before or after addition of one or more cutter stocks.

16. The method of claim 1, wherein the dispersed metal sulfide catalyst particles are less than 1 μm in size, or than about 500 nm in size, or less than about 100 nm in size, or less than about 25 nm in size, or less than about 10 nm in size.

17. The method of claim 1, the dispersed metal sulfide catalyst particles being formed in situ within the heavy oil from a catalyst precursor.

18. The method of claim 17, further comprising mixing the catalyst precursor with a diluent hydrocarbon to form a diluted precursor mixture, blending the diluted precursor mixture with the heavy oil to form conditioned heavy oil, and heating the conditioned heavy oil to decompose the catalyst precursor and form the dispersed metal sulfide catalyst particles in situ.

19. A method of upgrading an ebullated bed hydroprocessing system that includes one or more ebullated bed reactors to increase rate of production of converted products from heavy oil, comprising:

operating an ebullated bed reactor using a heterogeneous catalyst to hydroprocess heavy oil at initial reactor severity, including initial throughput of heavy oil, initial operating temperature in a range of about 399° C. (750° F.) to about 460° C. (860° F.), initial conversion of heavy oil, initial rate of production of converted products, and initial rate of fouling and/or sediment production;

thereafter upgrading the ebullated bed reactor to operate using a dual catalyst system comprised of dispersed metal sulfide catalyst particles less than 1 μm in size and heterogeneous catalyst; and operating the upgraded ebullated bed reactor using the dual catalyst system to hydroprocess heavy oil at higher reactor severity relative to the initial reactor severity, including (i) increasing the throughput of heavy oil by at least 10% relative to the initial throughput, (ii) increasing the operating temperature of the upgraded ebullated bed reactor by at least 5° C. relative to the initial operating temperature, and (iii) maintaining or increasing the conversion of heavy oil relative to the initial conversion in order to increase the rate of production of converted products while maintaining a rate of fouling and/or sediment production equal to or less than the initial rate of fouling and/or sediment production when operating the ebullated bed reactor at the initial reactor severity.

20. The method of claim 19, wherein operating the upgraded ebullated bed reactor at higher severity includes increasing the conversion of heavy oil relative to the initial conversion.

21. A method of upgrading an ebullated bed hydroprocessing system that includes one or more ebullated bed reactors to increase rate of production of converted products from heavy oil, comprising:

operating an ebullated bed reactor using a heterogeneous catalyst to hydroprocess heavy oil at initial reactor severity, including initial conversion, initial operating temperature in a range of about 399° C. (750° F.) to about 460° C. (860° F.), initial throughput of heavy oil, initial rate of production of converted products, and initial rate of fouling and/or sediment production;

thereafter upgrading the ebullated bed reactor to operate using a dual catalyst system comprised of dispersed metal sulfide catalyst particles less than 1 μm in size and heterogeneous catalyst; and operating the upgraded ebullated bed reactor using the dual catalyst system to hydroprocess heavy oil at higher reactor severity relative to the initial reactor severity, including (i) increasing the conversion of heavy oil by at least 10% relative to the initial conversion, (ii) increasing the operating temperature by at least 5° C. relative to the initial operating temperature, and (iii) maintaining or increasing the throughput of heavy oil relative to the initial throughput in order to increase the rate of production of converted products while maintaining a rate of fouling and/or sediment production equal to or less than the initial rate of fouling and/or sediment production when operating the ebullated bed reactor at the initial reactor severity.

22. The method of claim 21, wherein operating the upgraded ebullated bed reactor at higher severity includes increasing the throughput of heavy oil relative to the initial throughput.

23. A method of enhanced hydroprocessing of heavy oil by an ebullated bed hydroprocessing system that includes one or more ebullated bed reactors with increased rate of production of converted products from heavy oil compared to a conventional ebullated bed system when operating as designed, comprising:

providing an ebullated bed reactor designed to use a heterogeneous catalyst to hydroprocess heavy oil and which, when operated as designed, is capable of stable operation at baseline conditions, including a baseline reactor severity and baseline rate of production of converted products, wherein the baseline reactor severity includes a baseline operating temperature in a range of about 750° F. (399° C.) to about 860° F. (460° C.), baseline throughput of heavy oil, baseline conversion of heavy oil, and baseline rate of equipment fouling;

enhancing hydroprocessing of heavy oil by the ebullated bed reactor by introducing a dual catalyst system comprised of dispersed metal sulfide catalyst particles and heterogeneous catalyst into the reactor together with heavy oil and hydrogen; and operating the enhanced ebullated bed reactor using the dual catalyst system to hydroprocess heavy oil at a higher reactor severity relative to the baseline reactor severity to increase the rate of production of converted products relative to the baseline rate of production of converted products while maintaining a rate of equipment fouling that is equal to or less than the baseline rate of equipment fouling during stable operation of the ebullated bed reactor at the baseline conditions, wherein operating the enhanced ebullated bed reactor to hydroprocess heavy oil at higher reactor severity relative to the baseline reactor severity includes at least one of:

(i) increasing the operating temperature of the ebullated bed reactor by at least 5° C. relative to the baseline operating temperature, increasing the throughput of heavy oil by at least 10% relative to the baseline throughput, and maintaining or increasing the conversion of heavy oil relative to the baseline fractional conversion; or (ii) increasing the operating temperature of the ebullated bed reactor by at least 10° C. relative to the baseline operating temperature, increasing the fractional conversion of heavy oil by at least 10% relative to the baseline fractional conversion, and maintaining or increasing the throughput of heavy oil relative to the baseline throughput.

* * * * *